US009874320B2

(12) United States Patent
Price et al.

(10) Patent No.: US 9,874,320 B2
(45) Date of Patent: Jan. 23, 2018

(54) RETROFIT KIT FOR DROP CEILING LIGHTING FIXTURES

(71) Applicant: Hubbell Incorporated, Shelton, CT (US)

(72) Inventors: Russell A. Price, Yorba Linda, CA (US); Priyankkumar M. Desai, Stevenson Ranch, CA (US); David J Martin, Yorba Linda, CA (US); Justin W Ryver, Placentia, CA (US)

(73) Assignee: Hubbell Incorporated, Shelton, CT (US)

( * ) Notice: Subject to any disclaimer, the term of this patent is extended or adjusted under 35 U.S.C. 154(b) by 184 days.

(21) Appl. No.: 14/663,298

(22) Filed: Mar. 19, 2015

(65) Prior Publication Data

US 2015/0267873 A1 Sep. 24, 2015

Related U.S. Application Data

(60) Provisional application No. 61/955,595, filed on Mar. 19, 2014.

(51) Int. Cl.

| | |
|---|---|
| ***F21K 9/90*** | (2016.01) |
| ***F21V 21/03*** | (2006.01) |
| ***F21V 7/00*** | (2006.01) |
| ***F21S 8/02*** | (2006.01) |
| ***F21K 9/20*** | (2016.01) |
| ***F21K 9/27*** | (2016.01) |
| *F21Y 103/10* | (2016.01) |
| *F21Y 115/10* | (2016.01) |

(52) U.S. Cl.

CPC ..... *F21K 9/90* (2013.01); *F21K 9/20* (2016.08); *F21K 9/27* (2016.08); *F21S 8/026* (2013.01); *F21V 7/0066* (2013.01); *F21V 21/03* (2013.01); *F21Y 2103/10* (2016.08); *F21Y 2115/10* (2016.08); *Y10T 29/49117* (2015.01)

(58) Field of Classification Search

CPC ..... F21K 9/90; F21K 9/20; F21K 9/27; F21S 8/026; F21V 7/0066; F21V 21/03; Y10T 29/49117; F21Y 2103/10; F21Y 2115/10

See application file for complete search history.

(56) References Cited

U.S. PATENT DOCUMENTS 6,149,280 A * 11/2000 Quiogue ..... F21S 8/02 362/147
8,083,369 B1 12/2011 Richardson et al.
8,100,551 B2 1/2012 Mayfield, III (Continued)

OTHER PUBLICATIONS

International Preliminary Report on Patentability of the International Searching Authority dated Sep. 20, 2016 from PCT/US2015/021561, 6 pages.

(Continued)

*Primary Examiner* — Mary Ellen Bowman
(74) *Attorney, Agent, or Firm* — Dilworth IP LLC

(57) ABSTRACT

A retrofit kit for drop ceiling lighting fixtures and a method of retrofitting drop ceiling lighting fixtures are provided. The retrofit kit includes a pair of adapter brackets configured to be mounted to opposing sides of a drop ceiling fixture, and a door-light assembly configured to be pivotally coupled to one adapter bracket, and to be latched to the other adapter bracket.

14 Claims, 22 Drawing Sheets

(56) References Cited

U.S. PATENT DOCUMENTS

| | | | | |
|---|---|---|---|---|
| 8,272,763 | B1 * | 9/2012 | Chinnam | F21V 29/004 362/147 |
| 2013/0223100 | A1 | 8/2013 | Caferro et al. | |
| 2013/0235568 | A1 | 9/2013 | Green et al. | |

OTHER PUBLICATIONS

International Search Report and the Written Opinion of the International Searching Authority, or the Declaration mailed in PCT/US2015/021561 dated Jun. 26, 2015.

* cited by examiner

RETROFIT KIT FOR DROP CEILING LIGHTING FIXTURES

CROSS-REFERENCE TO RELATED APPLICATIONS

This application claims priority to U.S. Provisional Application No. 61/955,595, filed on Mar. 19, 2014, entitled "RETROFIT LED DOOR LIGHT ASSEMBLY KIT AND METHOD FOR TROFFER LIGHTING FIXTURES", which is incorporated herein in its entirety by reference.

BACKGROUND

Field

The present disclosure relates generally to the field of lighting fixtures, and more particularly, the present disclosure relates to retrofit kits for drop ceiling lighting fixtures and to door-light assemblies for drop ceiling lighting fixtures.

Description of the Related Art

A troffer lighting fixture is a square or rectangular light fixture with housing that fits in a modular dropped ceiling grid. Troffer lighting fixtures are commonly used in commercial offices and industrial spaces worldwide. In many installations, troffer lighting fixtures are populated with one or more straight fluorescent lamps that span the length of the light fixture. In other installations, troffer lighting fixtures are populated with U-shaped fluorescent lamps. Assess to the lamps is typically via a removable door frame.

As troffer lighting fixtures get older, they require more maintenance and eventually need to be replaced. Maintaining and replacing troffer lighting fixtures is often costly and time-consuming. In many cases, access to the recessed portion of the fixture is required to maintain or replace the fixtures. Such access may be difficult, and in some cases efforts to access the recessed portion of the troffer lighting fixture may risk exposure to airborne asbestos particles within the drop ceiling.

Recent advances in solid-state lighting technologies, particularly in light emitting diode (LED) lighting technologies, offer significantly longer operational lifetimes and increase lighting efficiencies which enable significant energy and cost savings. These benefits provide motivation to upgrade and replace fluorescent lighting fixtures, including troffer lighting fixtures, with the more efficient solid-state lighting technologies.

However, troffer lighting fixtures come in a variety of sizes, depths and configurations. Prismatic style troffer light fixtures include a flat lens in the door frame. Parabolic troffer light fixtures contain a diffuser that may be an architectural lens, perforated metal basket, or specular louvers in combination with reflectors. The variations in troffer light fixtures has made it difficult to develop a standardized kit to retrofit troffer lighting fixtures for solid state lighting sources, such as LED lighting sources.

SUMMARY

The present disclosure provides embodiments of retrofit kits for drop ceiling lighting fixtures. In an exemplary embodiment, the retrofit includes a first adapter bracket configured to be secured to a drop ceiling lighting fixture, a second adapter bracket configured to be secured to a drop ceiling lighting fixture, and a door-light assembly. The door light assembly includes a first side configured to be pivotally secured to the first adapter bracket, and a second side configured to be latched to the second adapter bracket. Preferably, the second side is opposite the first side. The door-light assembly further includes a reflector assembly, at least one solid state lighting source mounted to the at least one light source mounting surface, control electronics to control power to the at least one solid state lighting source, and a pair of end plates coupled to the reflector assembly. The reflector assembly includes a first surface for securing at least one hinge to the reflector assembly, a second surface for securing at least one latch to the reflector assembly, and at least one light source mounting surface.

The present disclosure also provides a method of retrofitting drop ceiling lighting fixtures having a housing for supporting components of the fixture. The drop ceiling lighting fixtures are already installed within a drop ceiling grid structure and connected to an electrical wiring system. The method includes removing at least one of the components within the drop ceiling lighting fixture. A first adapter bracket is positioned along a first side of the housing of the drop ceiling lighting fixture so that a base portion of the first adapter bracket is positioned between the housing of the drop ceiling lighting fixture and the grid structure, aligned with the housing of the drop ceiling lighting fixture until a stop flange portion of the first adapter bracket is engaged with the housing of the drop ceiling lighting fixture, and fastened to the first side of the housing of the drop ceiling lighting fixture. A second adapter bracket is positioned along a second side of the housing of the drop ceiling lighting fixture so that a base portion of the second adapter bracket is positioned between the housing of the drop ceiling lighting fixture and the grid structure, aligned with the housing of the drop ceiling lighting fixture until a stop flange portion of the second adapter bracket is engaged with the housing of the drop ceiling lighting fixture, and fastened the second adapter bracket to the second side of the housing of the drop ceiling lighting fixture. A door-light assembly is coupled to the first adapter bracket such that the door-light assembly can pivot between a suspended position and a latched position. The door-light assembly is connected to the electrical wiring system, and the door-light assembly is pivoted to the latched position where a latch is pivoted to secure the door light assembly in the latched position.

BRIEF DESCRIPTION OF THE DRAWINGS

The figures depict embodiments for purposes of illustration only. One skilled in the art will readily recognize from the following description that alternative embodiments of the structures illustrated herein may be employed without departing from the principles described herein, wherein.

DETAILED DESCRIPTION

Figure 1:
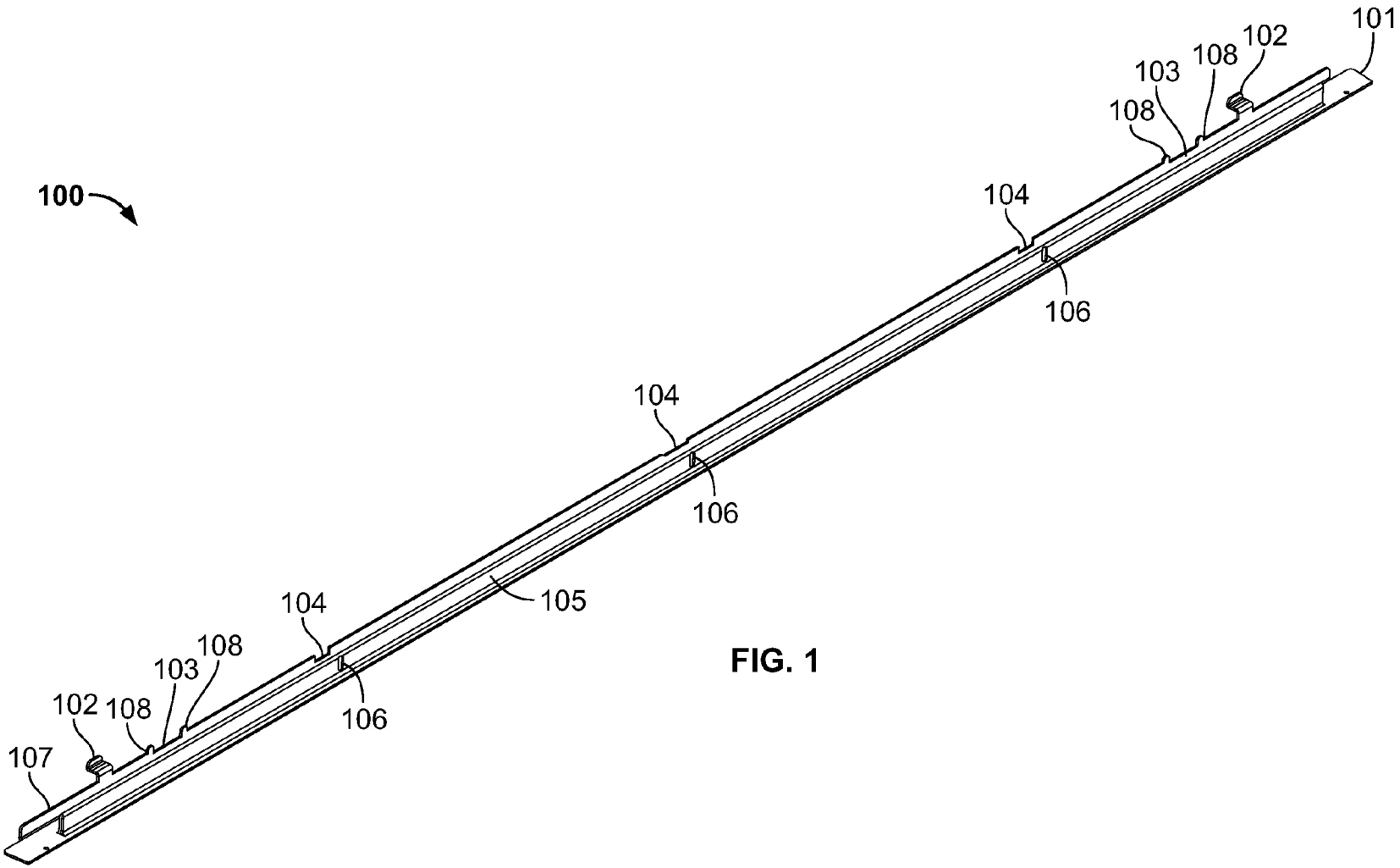
FIG. 1 is a first perspective view of an exemplary embodiment of an adapter bracket according to the present disclosure that can be included as part of a retrofit kit according to the present disclosure.

The following description and drawings are illustrative and are not to be construed as limiting. Numerous specific details are described to provide a thorough understanding of the disclosure. However, in certain instances, well known or conventional details are not described in order to avoid obscuring the description.

Reference in this specification to "one embodiment," "an embodiment" or the like means that a particular feature, structure, characteristic, advantage or benefit described in connection with the embodiment may be included in at least one embodiment of the disclosure, but may not be exhibited by other embodiments. The appearances of the phrase "in one embodiment" in various places in the specification are not necessarily all referring to the same embodiment, nor are separate or alternative embodiments mutually exclusive of other embodiments. Similarly, various requirements are described which may be requirements for some embodiments but not for other embodiments. The specification and drawings are to be regarded in an illustrative sense rather than a restrictive sense. Various modifications may be made thereto without departing from the spirit and scope as set forth in the claims.

A modular dropped ceiling grid is generally formed of interconnected inverted T-bars that are permanently attached to rigid ceiling supports, via wires or other structural means, to form a rectangular or square grid structure. Troffer lighting fixtures and ceiling tiles rest within the rectangular or square grid structure to complete the drop ceiling. Troffer lighting fixtures are fluorescent lighting fixtures that include a housing having four sidewalls forming a square or rectangular shape to fit within the rectangular or square grid structure. When installed, the housing is recessed within the drop ceiling. Troffer lighting fixture components, such as reflectors, door frames, lenses, louvers, fluorescent lamps, lamp sockets, socket brackets, one or more ballast units, and associated electrical wiring are located and connected within the housing. The components included within a particular troffer lighting fixture depend on the make, model and type of troffer lighting fixture. The present disclosure provides retrofit kits for troffer lighting fixtures to upgrade the fixtures to solid state lighting fixtures. Embodiments of the retrofit kits according to the present disclosure include embodiments of door-light assemblies and embodiments of adapter brackets used to couple a door-light assembly to a troffer lighting fixture. The door-light assemblies are pivotally secured to one adapter bracket attached to one side of a troffer lighting fixture, and latched to the other adapter bracket secured to an opposite side wall of the troffer lighting fixture. Other embodiments of the retrofit kit include separate hinges to pivotally secure a door-light assembly to a troffer lighting fixture, and separate latches to latch the door-light assembly to the troffer lighting fixture.

Figure 2:
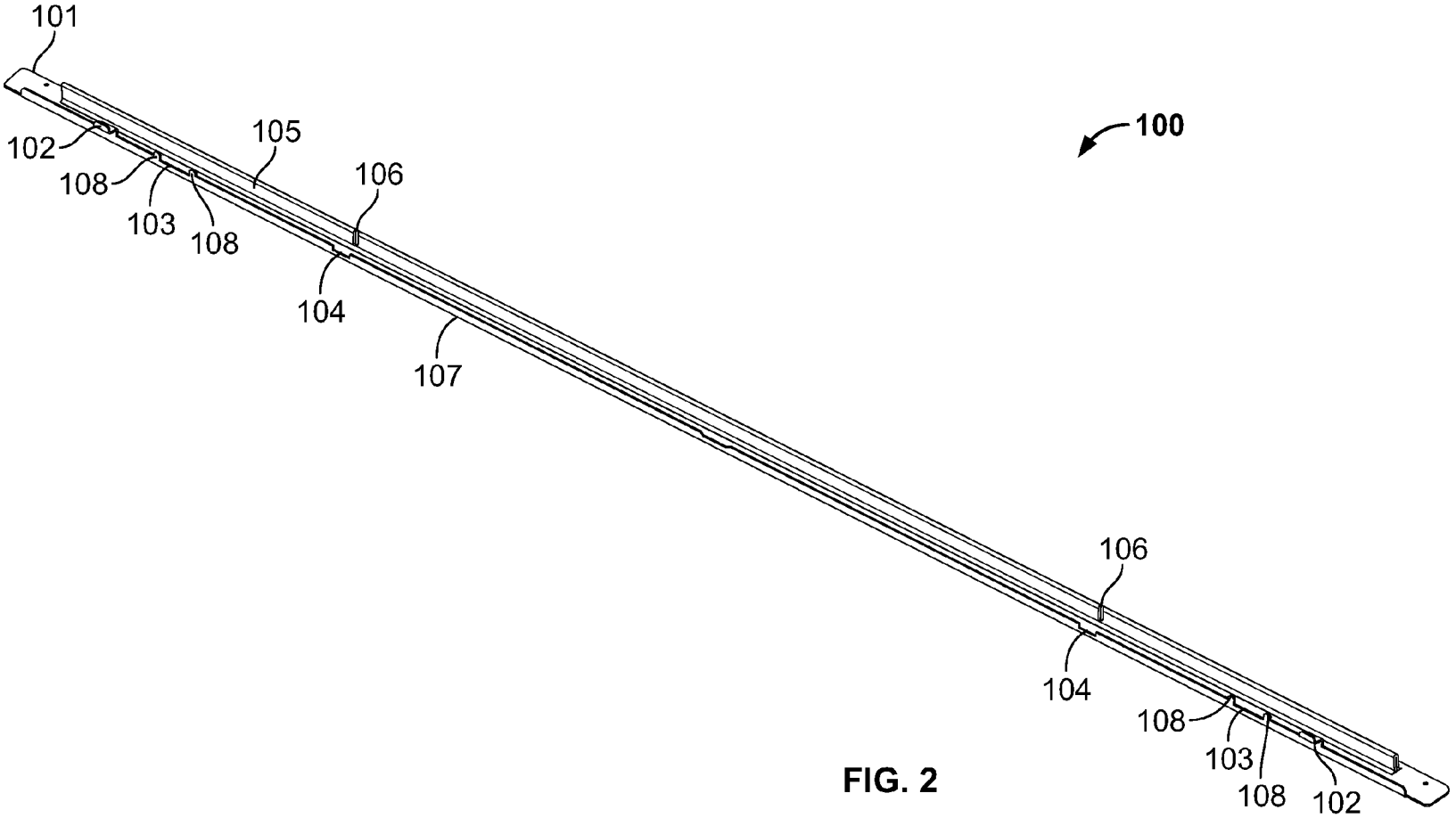
FIG. 2 is a second perspective view of the adapter bracket of FIG. 1.
Figure 3:
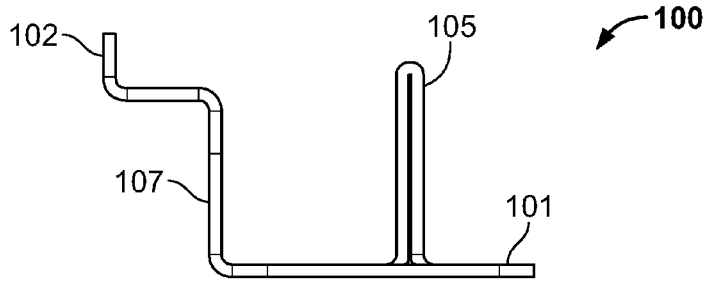
FIG. 3 is an end view of the adapter bracket of FIG. 1.
Figure 4:
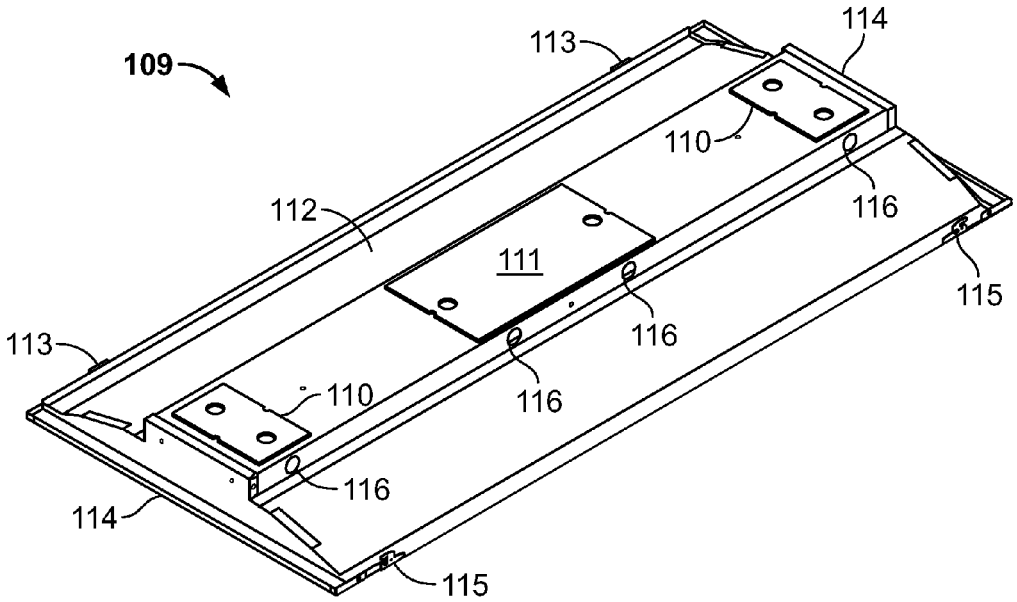
FIG. 4 is a first top perspective view of an exemplary embodiment of a door-light assembly according to the present disclosure that can be included as part of a retrofit kit according to the present disclosure.

Referring to FIGS. 1-3, various views of an exemplary embodiment of an adapter bracket according to the present disclosure are shown. Each adapter bracket 100 has a base portion 101, a stop flange portion 105, and a mounting flange portion 107. The width of the adapter bracket 100 is preferably wider than a drop ceiling T-bar so that when installed, the T-bar, adapter brackets, door-light assembly, and troffer lighting fixture housing provide a uniform appearance. The stop flange portion 105 and mounting flange portion 107 are preferably perpendicular to the base portion 101, as shown.

The stop flange portion 105 of the adapter bracket 100 is used to align the adapter bracket 100 along an edge of the troffer lighting fixture, as will be described below. The stop flange portion 105 may be formed as a hem in order to provide additional structural stiffness to the adapter bracket 100. The mounting flange portion 107 of the adapter bracket 100 has two latch retainers, e.g., latch tabs 102, which serve as latch points for the door-light assembly, as will described below. The mounting flange portion 107 has two hinge supports, where each hinge support includes a hinge clearance cutout 103 and corresponding hinge retainer tabs 108 on each side of the hinge clearance cutout 103. The hinge supports are used to support one or more hinges 113 secured to the door-light assembly 109. The mounting flange portion 107 includes clearance cutouts 104 to provide clearance for an installation tool, such as a screw driver, and a cutout 106, e.g., an oval cutout, to permit fastening of the adapter bracket 100 to the housing of an existing troffer lighting fixture, using fasteners, such as Tek screws.

Referring to FIGS. 4-8 an exemplary embodiment of a door-light assembly according to the present disclosure is shown. In this embodiment, the door-light assembly 109 includes a reflector assembly 112, a pair of end plates 114, one or more solid state lighting sources, e.g., solid state lighting modules 118, and control electronics 122 to control power to the one or more solid state lighting sources. The door-light assembly 109 may also include optical lenses 117 that provide protection to the one or more solid state lighting sources and control emission of light from the one or more solid state lighting sources.

The reflector assembly 112 has a compartment 112*b* extending along a length of the reflector assembly, as shown. The reflector assembly compartment 112*b* includes cutouts for end-access covers 110 and for a center axis cover 111. The compartment 112*b* cutouts provide access to control electronics 122 located within the compartment 112*b*, seen in FIG. 8. The reflector assembly 112 also includes flanges 112*a* on the sides of the reflector assembly 112 that create a surface for mounting one or more hinges 113, and one or more latches 115. Knockout holes 116 are located along the length of the reflector assembly compartment 112*b* to provide options for making electrical connections from a power source to the control electronics of the door-light assembly 109. The reflector assembly 112 also includes one or more mounting plates 119 for mounting the one or more solid state lighting sources 118 to the reflector assembly 112. The reflector assembly 112 includes one or more lens mounting tabs 121 used to mount the one or more of the optional optical lenses 117 to the reflector assembly 112.

Figure 8:
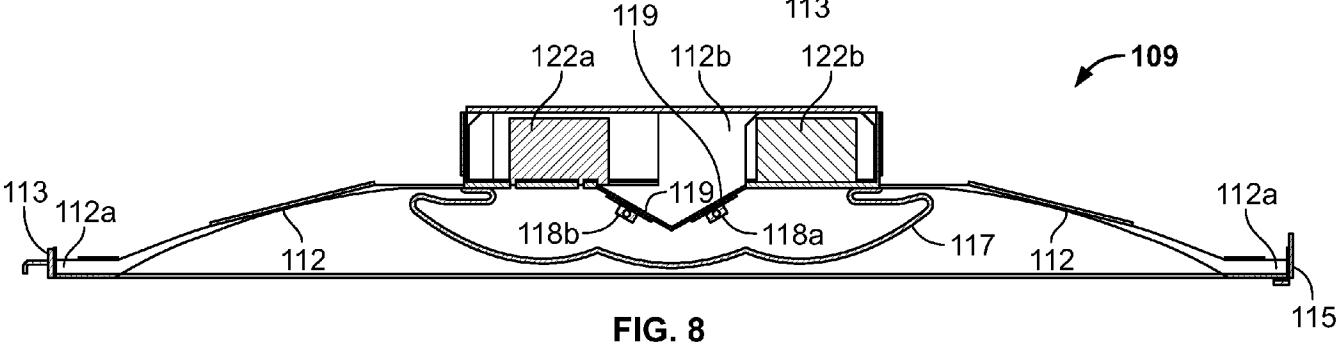
FIG. 8 is a cross-sectional view of the door-light assembly of FIG. 4.

The end plates 114 are connected to the ends of the reflector assembly 112 to create a frame for the door-light assembly 109. As noted, the door-light assembly includes one or more solid state lighting sources 118 that are secured to the mounting plates 119 of the reflector assembly 112 and are electrically connected to the control electronics 122. The solid state lighting sources of the present disclosure can include LED lighting modules, such as the PrevaLED lighting module manufactured by Osram, and the ZH series and Zhaga series of linear LED modules, manufactured by Universal Lighting Technologies. The control electronics 122 are mounted within the compartment 112*b* of the reflector assembly 112 and provide power to the solid state lighting sources 118. The embodiment of the door-light assembly 109 of FIGS. 4-8 illustrates a reflector assembly configured to fit within a 2'×4' rectangular housing of a troffer lighting fixture. As seen in FIG. 8, the reflector assembly 112 includes a pitched area adjacent to the compartment 112*b* that is formed by two mounting plates 119 and is provided to direct light emitted by solid state lighting sources 118 mounted to the mounting plates 119. The pitched area of the reflector assembly 112 can take any shape for optimized light distribution. In this embodiment, the control electronics 122 are preferably positioned within the compartment 112*b* on a side opposite the solid state lighting module 118 that the control electronics controls. To illustrate, the control electronics 122*a*, seen in FIG. 8, controls solid state lighting module 118*a*, and the control electronics 122*b* controls solid state lighting module 118*b*. In this configuration, the control electronics 122 are better isolated from the solid state lighting modules 118.

It should be noted that the reflector assembly 112 is configured and dimensions to fit within the housing of a troffer lighting fixture. For example, if the housing of the troffer lighting fixture were a 2'×2' square housing, the reflector assembly 112 would be configured to fit within the 2'×2' square housing. As another example, if the housing of the troffer lighting fixture were a 2'×4' rectangular housing, the reflector assembly 112 would be configured to fit within the 2'×4' rectangular housing. It should also be noted that the present disclosure contemplates different configurations for the reflector assembly 112 to achieve different lighting characteristics by using different geometries and orientations, different optical lenses 117 with different optical characteristics, and solid state lighting sources 118 with different light generation characteristics.

Figure 5:
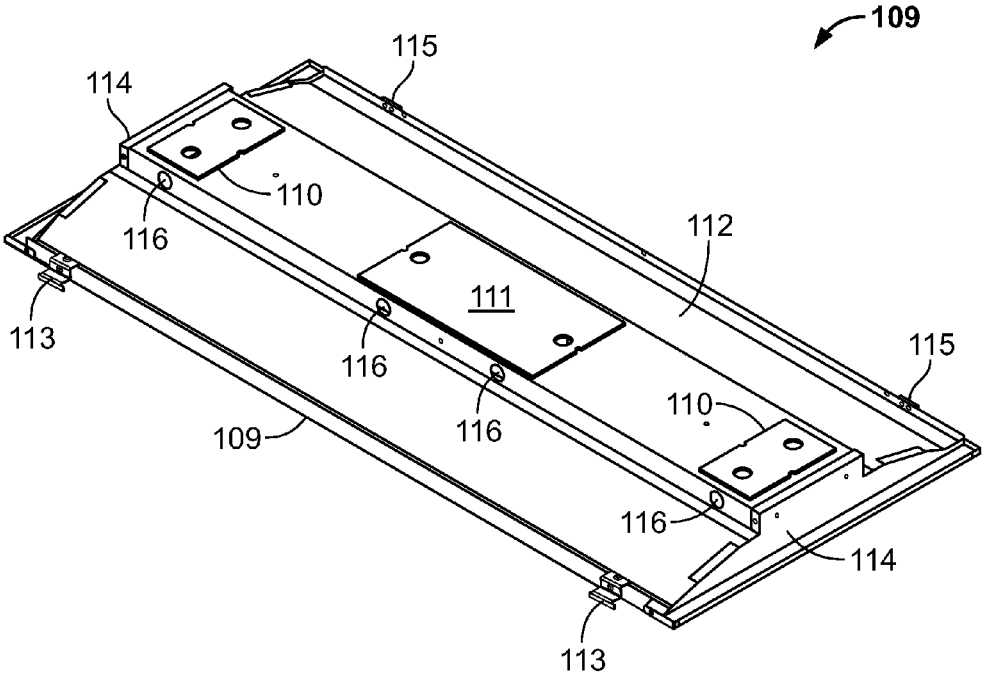
FIG. 5 is a second top perspective view of the door-light assembly of FIG. 4.
Figure 6:
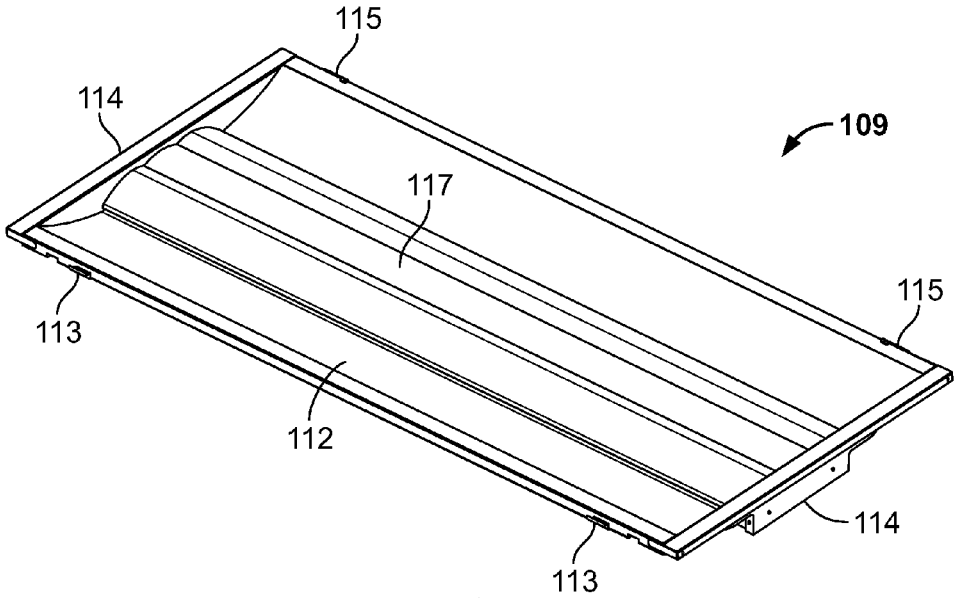
FIG. 6 is a bottom perspective view of the door-light assembly of FIG. 4.
Figure 7:
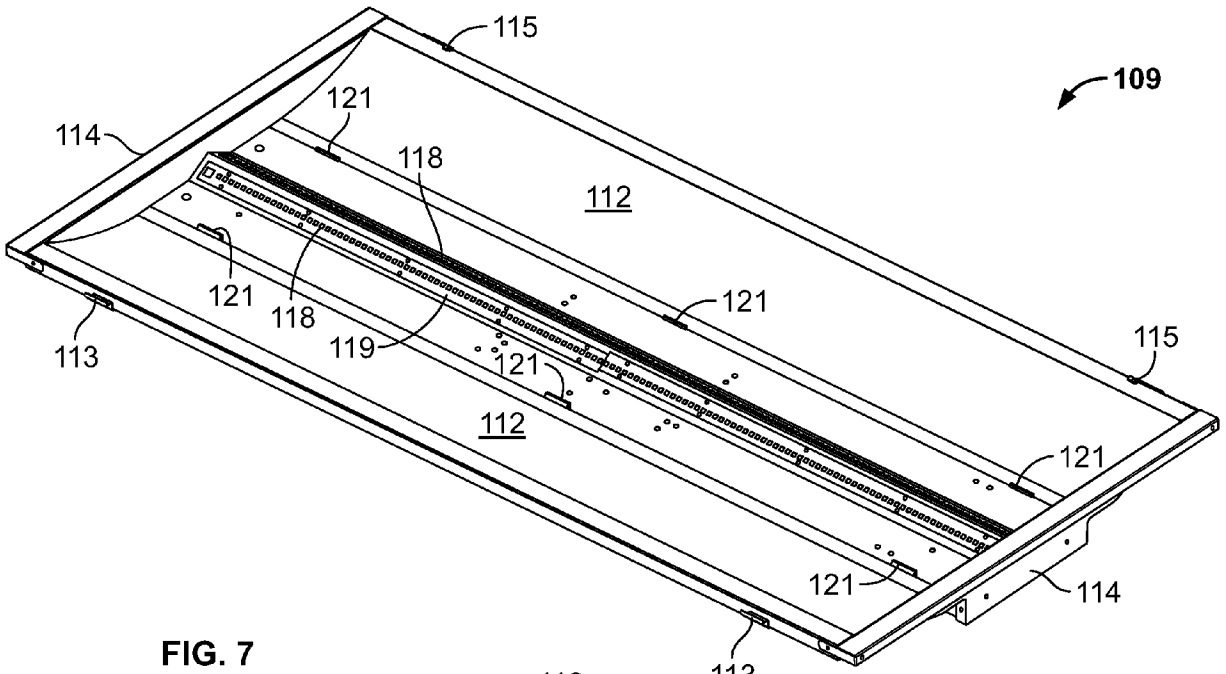
FIG. 7 is a bottom perspective view of the door-light assembly of FIG. 4, illustrating the door-light assembly without an optical lens.
Figure 9:
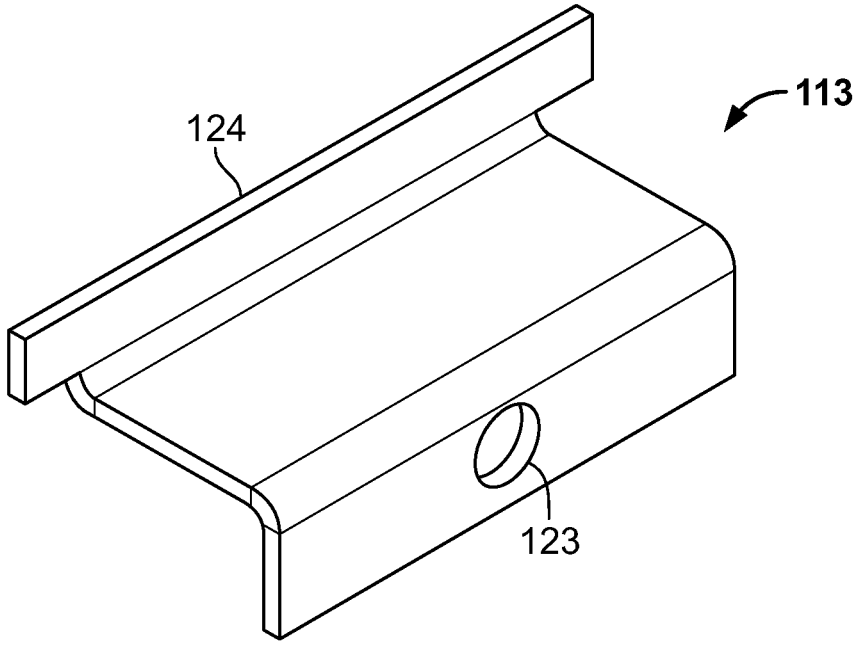
FIG. 9 is a perspective view of an exemplary embodiment of a hinge for the door-light assembly of FIG. 4 that can be included as part of a retrofit kit according to the present disclosure.

Referring to FIGS. 9-14, embodiments of the hinge 113 and latch 115 used to connect the door-light assembly 109 of the present disclosure to a housing of an existing troffer lighting fixture 129, and to latch the door-light assembly 109 to the housing of the troffer lighting fixture are shown. The hinge and latch can be secured to the door-light assembly as part of the retrofit kit, or the hinge and latch can be provided as separate components of the retrofit kit. In this exemplary embodiment, multiple hinges 113 are used to pivotally mount the door-light assembly 109 to the housing of the troffer lighting fixture 129, and multiple latches 115 are used to latch the door-light assembly 109 to the housing of the troffer lighting fixture. However, a single elongated hinge can be used to couple the door-light assembly 109 of the present disclosure to a housing of an existing troffer lighting fixture 129, and a single latch can be used to latch the door-light assembly 109 to the housing of the troffer lighting fixture. As seen in FIG. 9, each hinge 113 is a plate-like structure that includes a mounting hole 123 and a mounting flange 124. The mounting hole 123 is used to fasten the hinge 113 to the frame of the door-light assembly 109 using fasteners, such as Tek screws, as seen in FIG. 5. The mounting flange 124 is used to pivotally couple the door-light assembly 109 to the adapter bracket 100 secured to the housing of the troffer lighting fixture 129.

Figure 10:
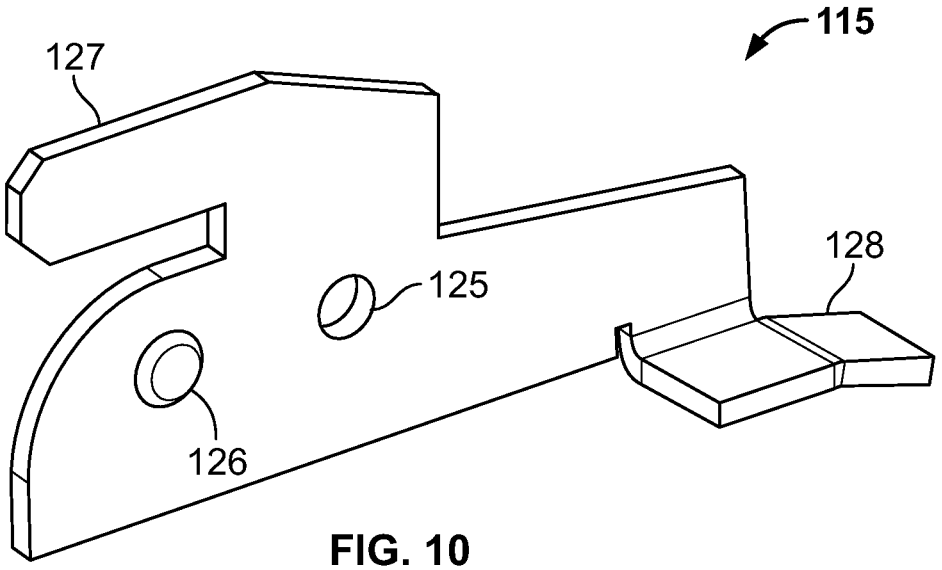
FIG. 10 is a perspective view of an exemplary embodiment of a latch for the door-light assembly of FIG. 4 that can be included as part of a retrofit kit according to the present disclosure.
Figure 14:
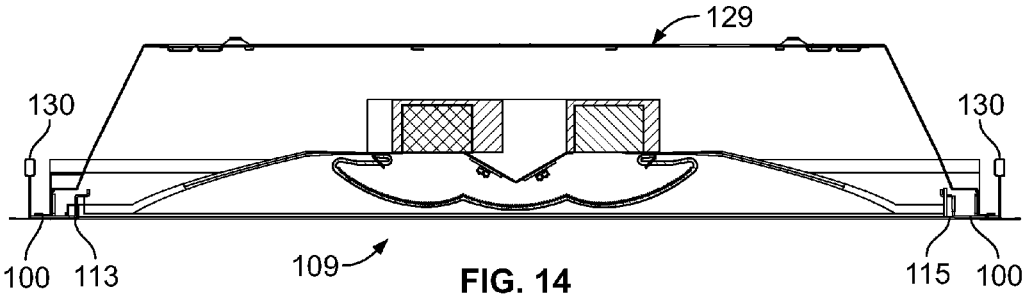
FIG. 14 is a cross-sectional view of the retrofitted troffer lighting fixture of FIG. 11, and illustrating the door-light assembly in a latched position.

As seen in FIG. 10, each latch 115 has a mounting hole 125, a dimple stop 126, a latch lever 127 and a latch tab 128. The mounting hole 125 is used to fasten the latch 115 to the frame of the door-light assembly 109 using fasteners, such as Tek screws, so that the latch 115 can rotate when force is applied to latch tab 128. Rotating the latch permits engagement or disengagement of the latch lever 127 of the latch 115 with the latch retainer, e.g., latch tab 102, of adapter bracket 100 attached to the opposite side of the housing of the troffer lighting fixture 129, as seen in FIG. 14. As the latch lever 127 is rotated into engagement with the latch retainer, e.g., latch tab 102, of adapter bracket 100, the dimple stop 126 engages a flange of the reflector assembly 112 to limit the rotation of the latch 115.

Figure 11:
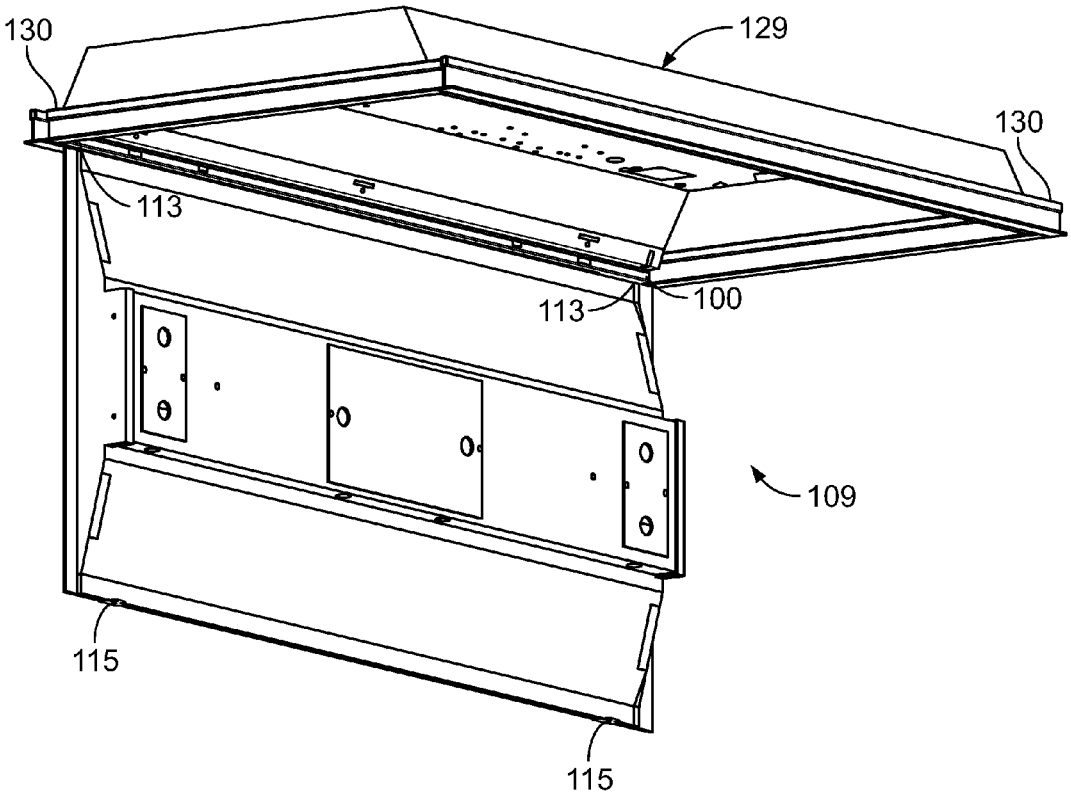
FIG. 11 is a perspective view of an exemplary embodiment of a troffer lighting fixture retrofitted with a retrofit kit according to the present disclosure, and illustrating a door-light assembly of the retrofit kit in a suspended position.
Figure 12:
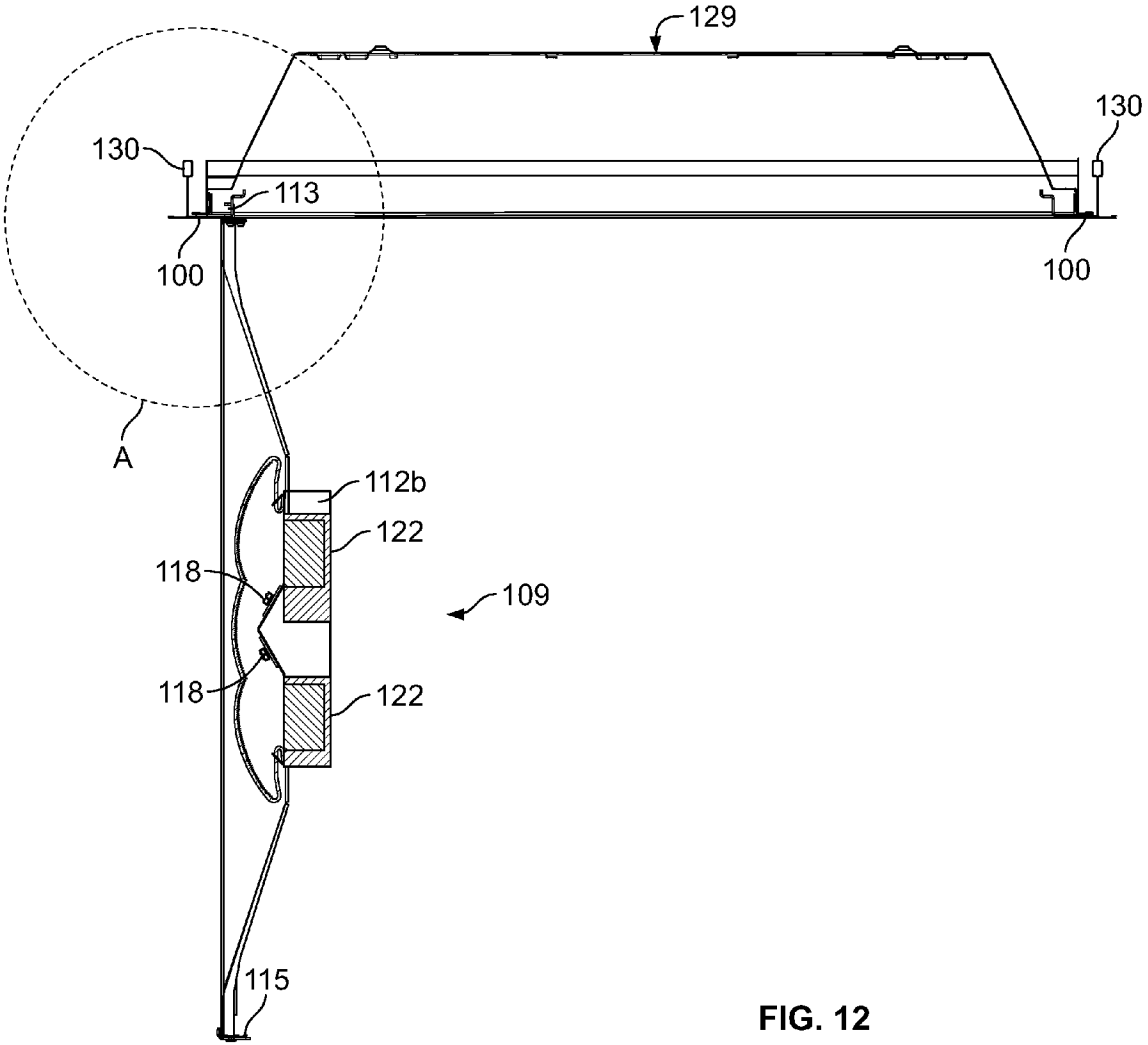
FIG. 12 is a cross-sectional view of the retrofitted troffer lighting fixture of FIG. 11.
Figure 13:
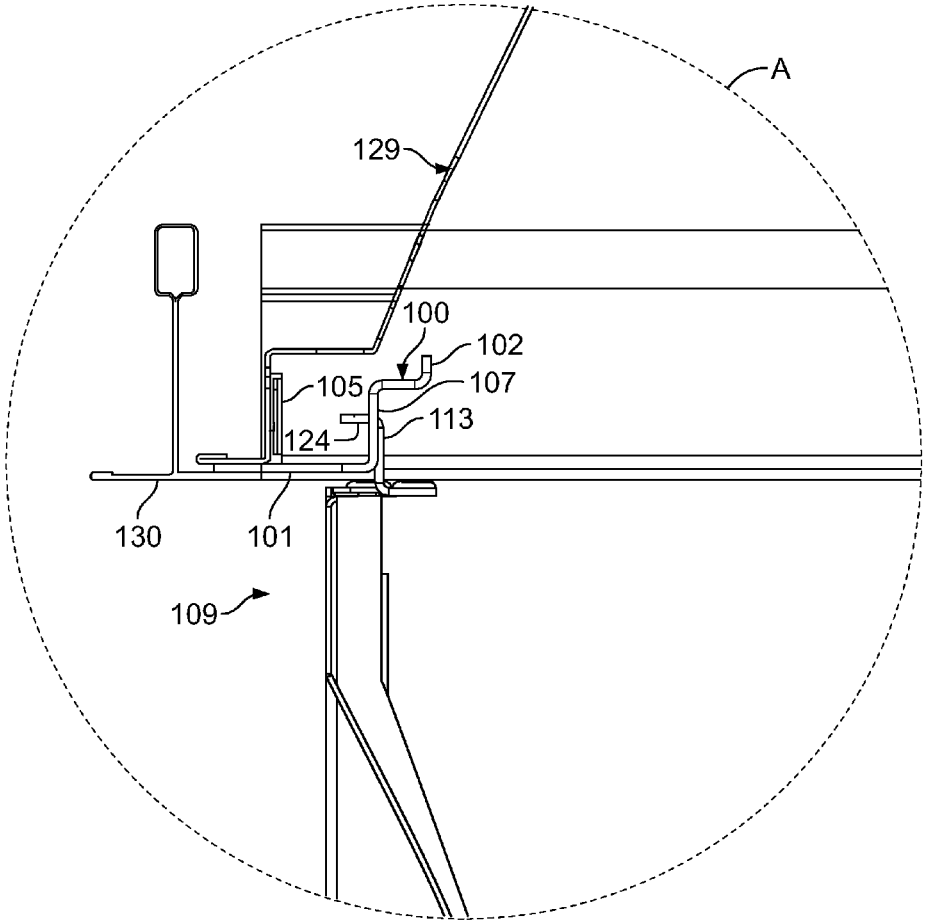
FIG. 13 is a detailed view of section "A" of FIG. 12.

Referring to FIGS. 11-14, the coupling of the retrofit kit, i.e., the door-light assembly 109 to the housing of a troffer lighting fixture 129 using the adapter brackets 100 is shown. In FIGS. 11-13, the door-light assembly 109 is unlatched from the adapter bracket 100 attached to the housing of the troffer lighting fixture 129 such that the door-light assembly is in a suspended position. As noted above, one adapter bracket 100 is used to pivotally couple one side of the door-light assembly 109 to a troffer lighting fixture 129, and another adapter bracket 100 is used to latch the side of the door-light assembly opposite the hinged side to the housing of the troffer lighting fixture. As shown in FIG. 13, the adapter bracket 100 is secured to the housing of the troffer lighting fixture 129 so that the adapter bracket 100 is positioned between the troffer lighting fixture and a drop ceiling T-bar 130 when the fixture 129 is installed in a drop ceiling. More specifically, the stop flange 105 of adapter bracket 100 is aligned against the side of the troffer fixture 129, and the base portion 101 of adapter bracket 100 is aligned between the drop ceiling T-bar 130 and the troffer lighting fixture 129. As noted, the mounting flange portion 107 of adapter bracket 100 has two hinge supports, where each hinge support includes a hinge clearance cutout 103 and corresponding hinge retainer tabs 108 on each side of the hinge clearance cutout 103. The hinge supports are used to support hinges 113 secured to the door-light assembly 109. The mounting flange 124 of the hinge 113 is positioned within the hinge clearance cutout 103 and the corresponding retainer tabs 108 of the hinge support of the adapter bracket 100 to pivotally couple the door-light assembly 109 to the adapter bracket 100. To latch the door-light assembly 109 to the housing of the troffer lighting fixture 129, the door-light assembly 109 is lifted so that it pivots on hinges 113 until the latches 115 are positioned in close proximity to the latch retainer, e.g., latch tabs 102, of the other adapter bracket 100. The latch tab 128 is then rotated such that latch lever 127 of latch 115 is rotated into engagement with the latch tab 102 of adapter bracket 100 until dimple stop 126 of latch 115 engages the flange 112*a* of the reflector assembly 112 so that the door-light assembly 109 is in the latched position, as seen in FIG. 14.

Figure 15:
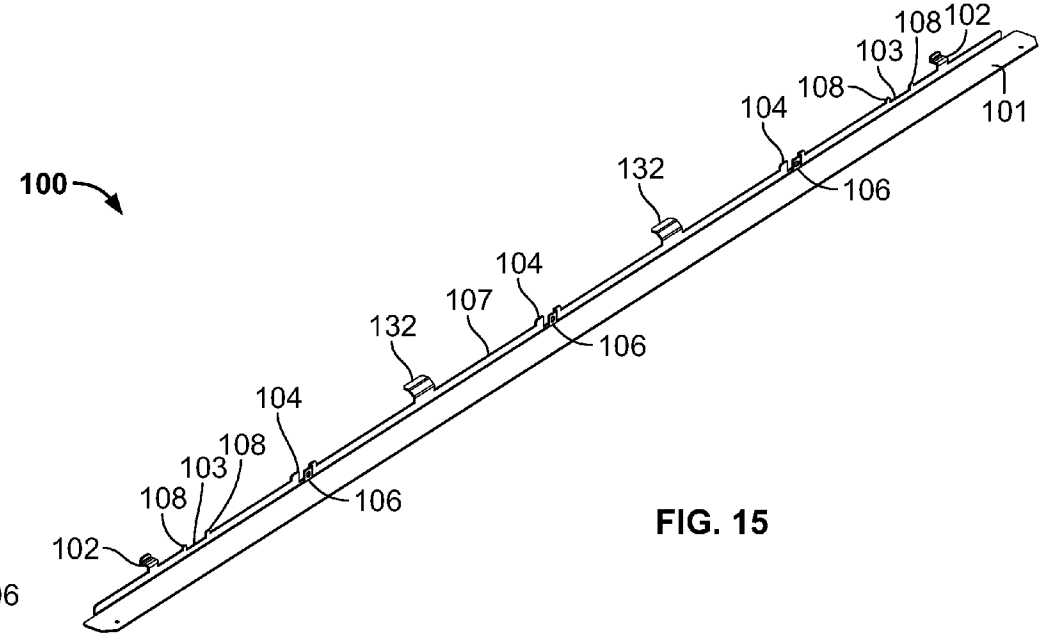
FIG. 15 is a first perspective view of another exemplary embodiment of an adapter bracket according to the present disclosure that can be included as part of a retrofit kit according to the present disclosure.
Figure 16:
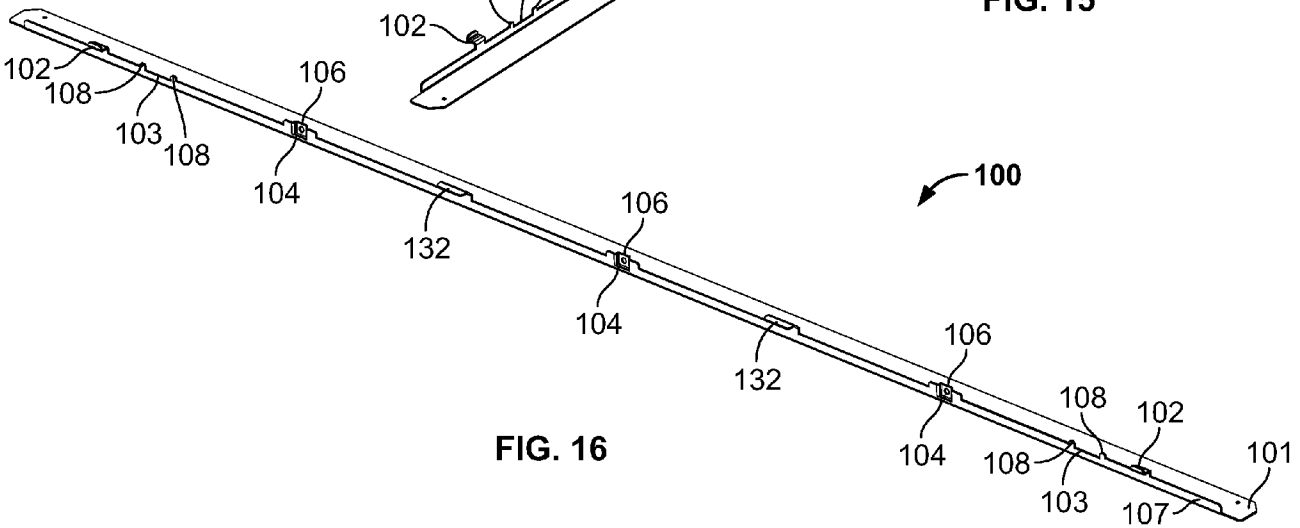
FIG. 16 is a second perspective view of the adapter bracket of FIG. 15.
Figures 17, 18:
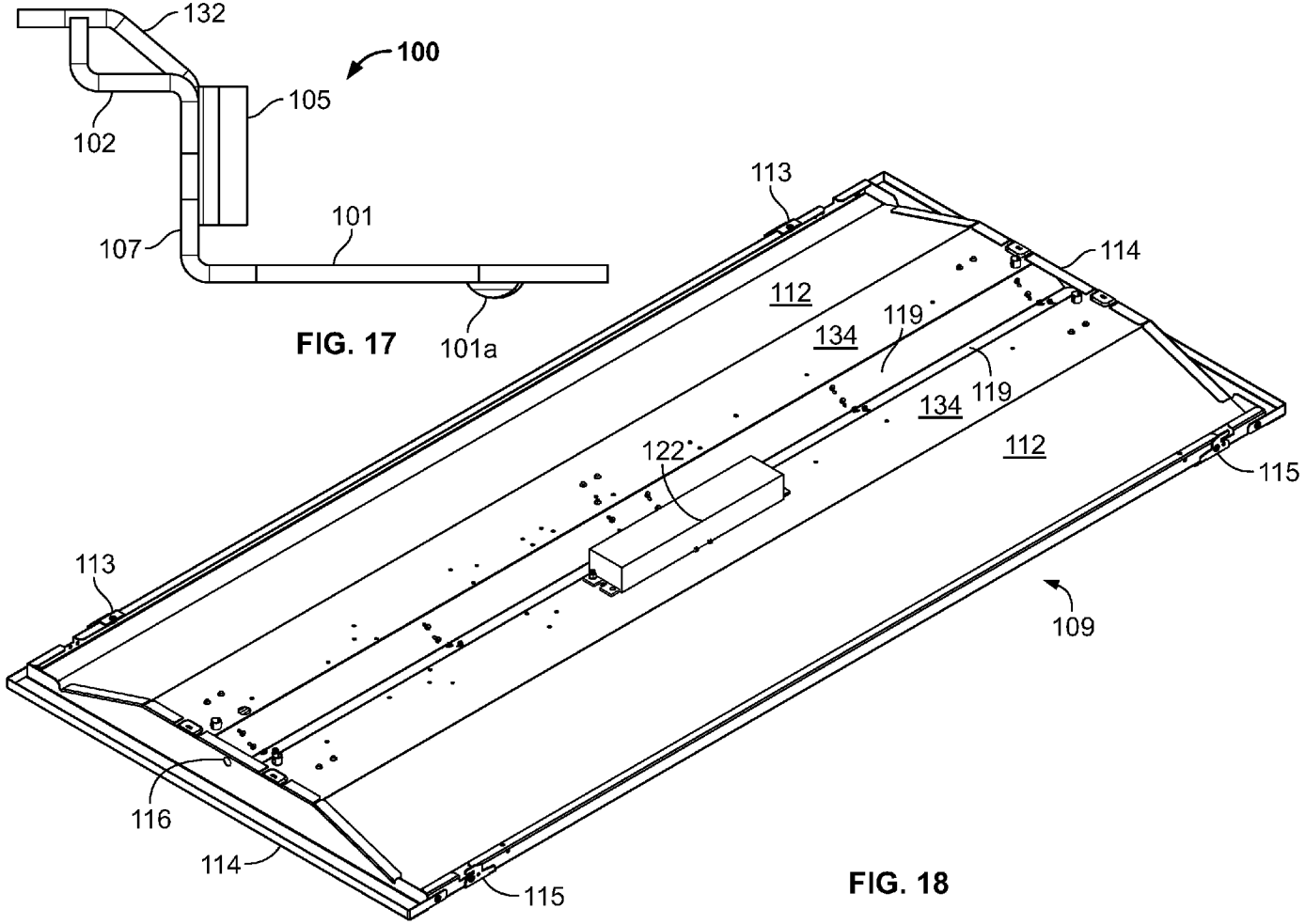
FIG. 17 is an end view of the adapter bracket of FIG. 15.
FIG. 18 is a first top perspective view of another exemplary embodiment of a door-light assembly according to the present application that can be included as part of a retrofit kit according to the present disclosure.
Figure 19:
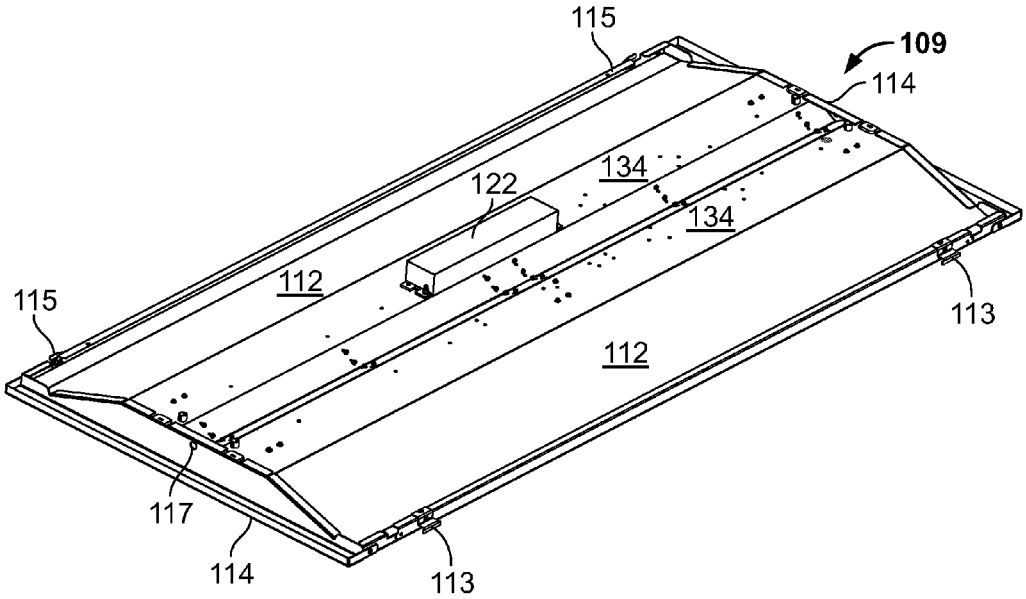
FIG. 19 is a second top perspective view of the door-light assembly of FIG. 18.
Figure 20:
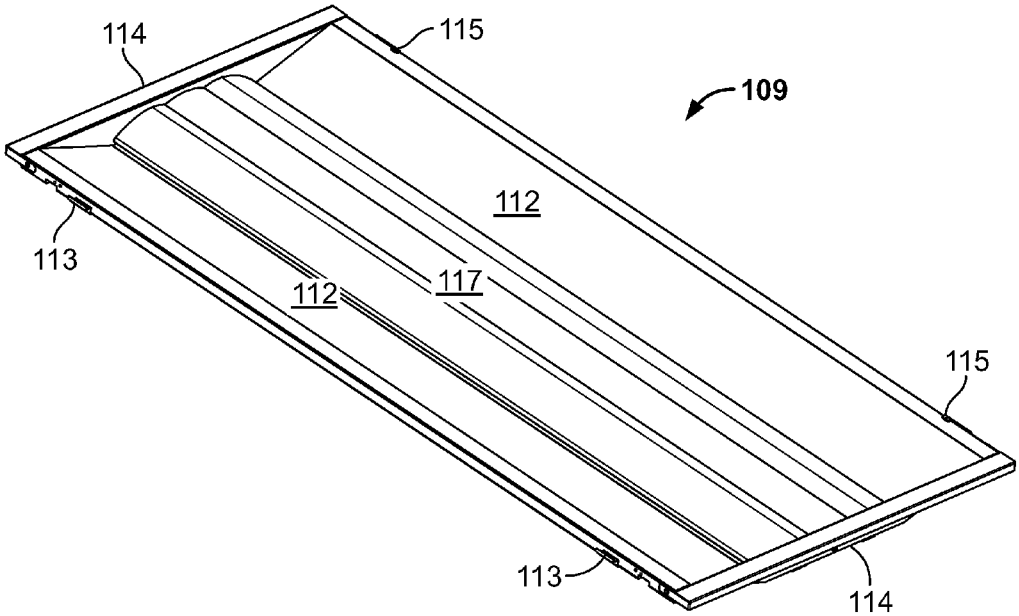
FIG. 20 is a bottom perspective view of the door-light assembly of FIG. 18.
Figure 21:
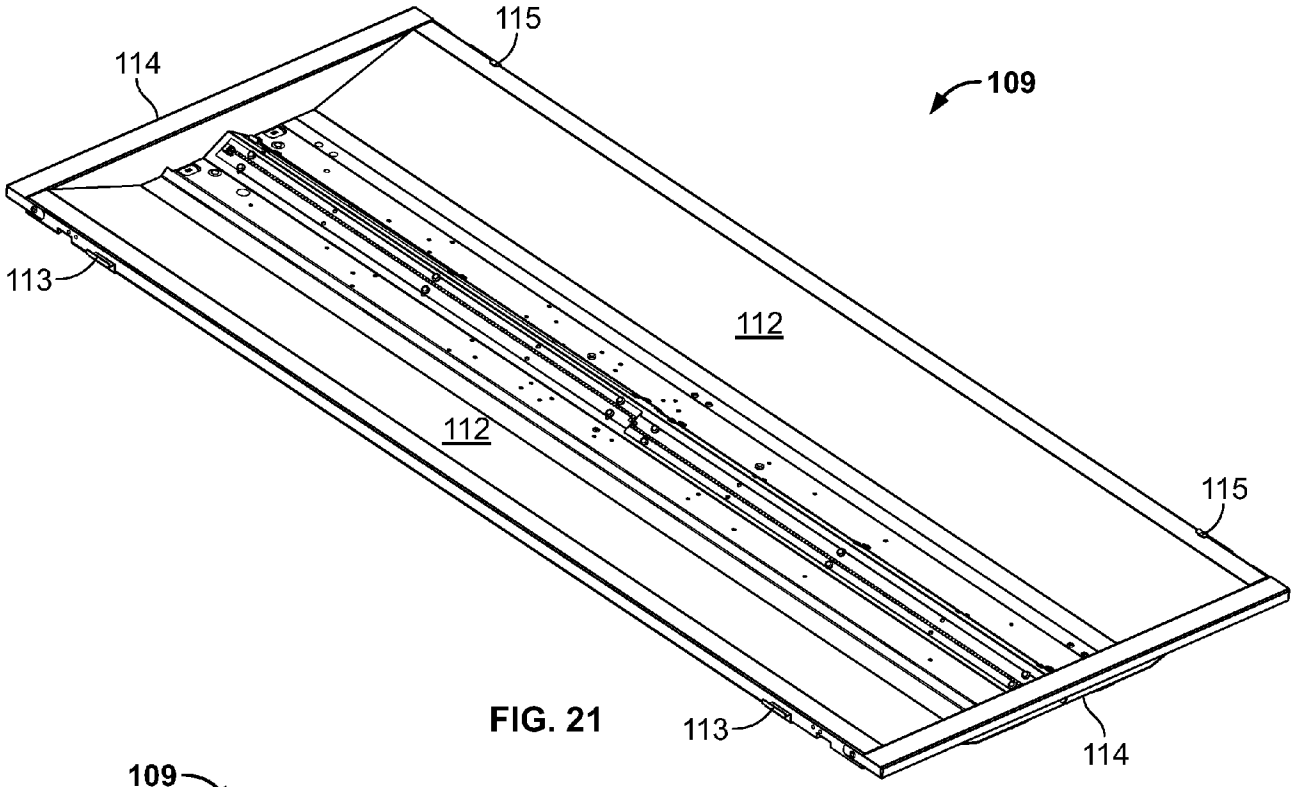
FIG. 21 is a bottom perspective view of the door-light assembly of FIG. 18, illustrating the door-light assembly without an optical lens.

Referring now to FIGS. 15-17, various views of another exemplary embodiment of the adapter bracket that may be used in the retrofit kit of the present disclosure are provided. In this exemplary embodiment, each adapter bracket 100 has many of the same features as the embodiment of the adapter bracket 100 shown in FIGS. 1-3. In this second embodiment, the mounting flange portion 107 includes two limiting tabs 132 that are used to maintain an even gap or spacing between the door-light assembly 109 and the adapter bracket 100 when the door-light assembly 109 is in the latched position. The even gap provides a uniform look when the kit is installed. In addition, in this exemplary embodiment, the stop flange portion 105 is secured to the mounting flange portion 107, as seen in FIG. 17, and dimple stop 101*a* is provided in base 101. The dimple stop is provided to align the adapter bracket 100 with the troffer lighting fixture housing and the grid structure.

Referring to FIGS. 18-22 various views of another exemplary embodiment of a door-light assembly 109 that can be included in the retrofit kit according to the present disclosure are provided. In this exemplary embodiment, the door-light assembly 109 has many of the same features as the embodiment of the door-light assembly 109 shown in FIGS. 4-8. In addition, the door-light assembly 109 also includes knock-out holes 116 in each end plate 114 for additional component wiring, and the reflector assembly 112 includes flat surfaces 134 for the mounting of the control electronics 122 on an inner surface of the reflector assembly 112. The center portion of the reflector assembly 112 includes pitched mounting plates 119 for the mounting of one or more solid state lighting sources 118 so as to direct light emitted by the one or more solid state lighting sources 118.

Figure 22:
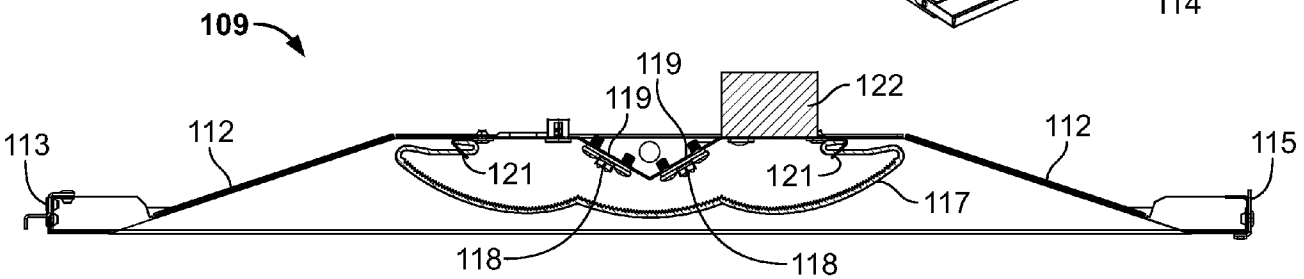
FIG. 22 is a cross-sectional view of the door-light assembly of FIG. 18.
Figure 23:
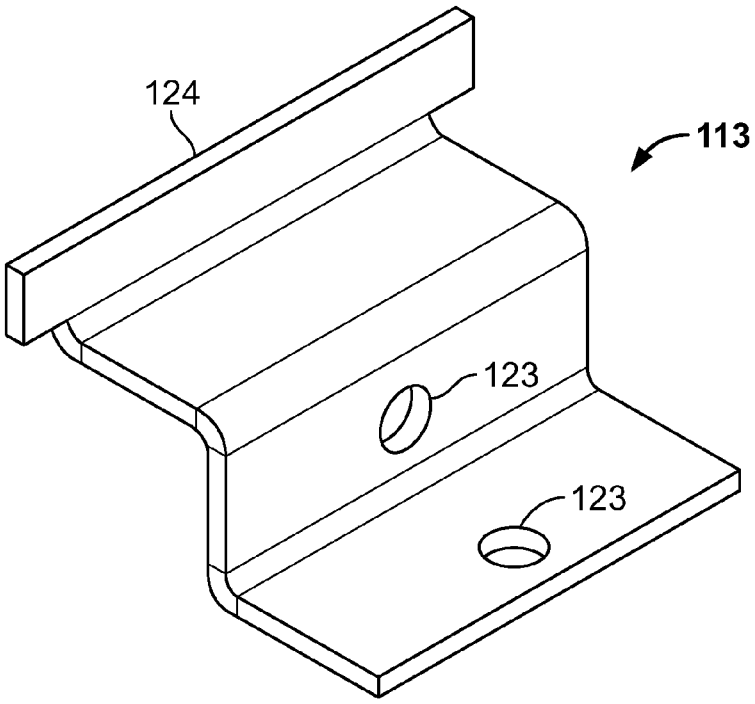
FIG. 23 is a perspective view of another exemplary embodiment of a hinge for the door-light assembly according to the present disclosure that can be included as part of a retrofit kit according to the present disclosure.
Figure 25:
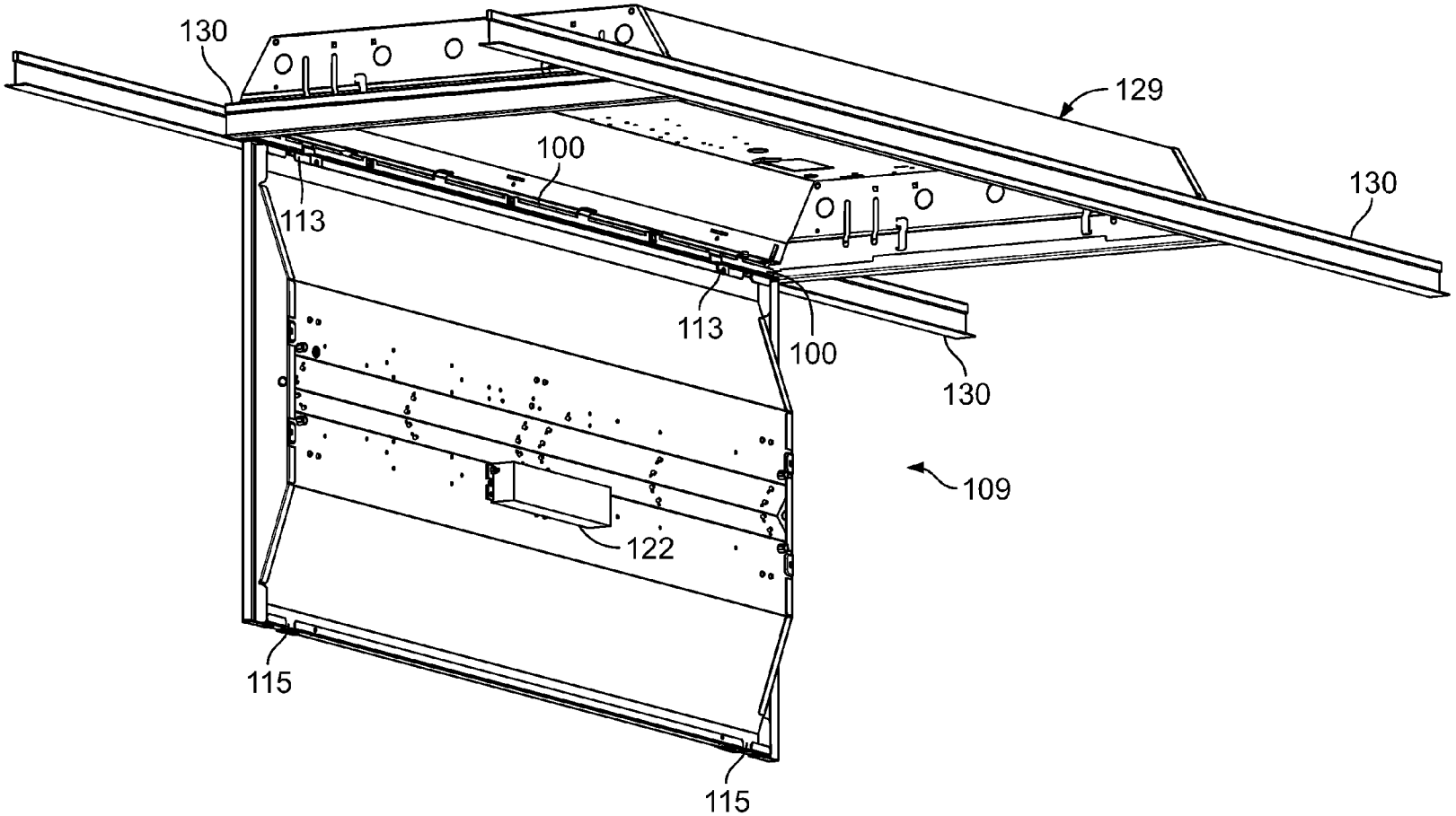
FIG. 25 is a perspective view of a troffer lighting fixture retrofitted with another exemplary embodiment of a retrofit kit according to the present disclosure, and illustrating another exemplary embodiment of the door light assembly in a suspended position.
Figure 26:
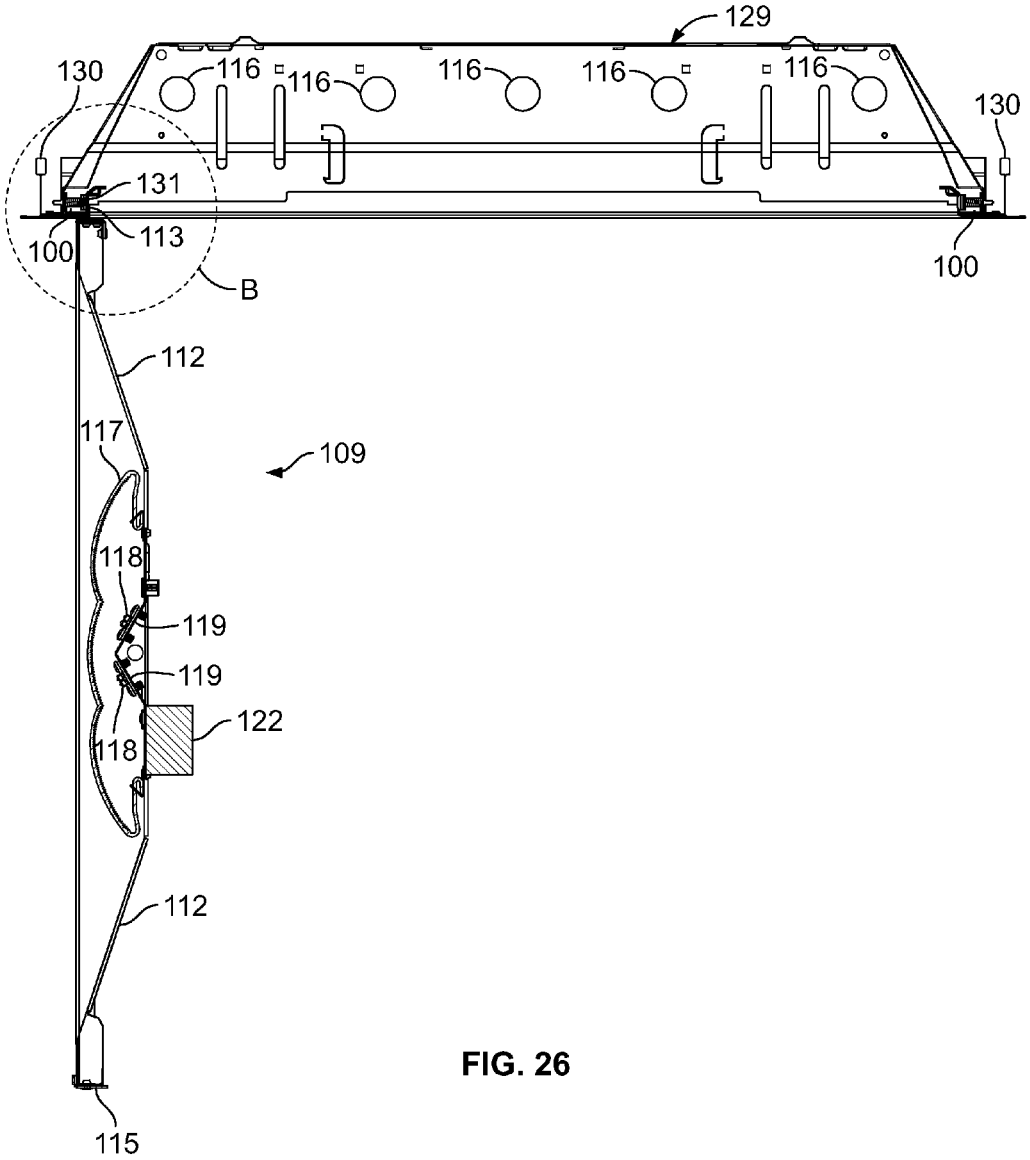
FIG. 26 is a cross-sectional view of the retrofitted troffer lighting fixture of FIG. 25.
Figure 27:
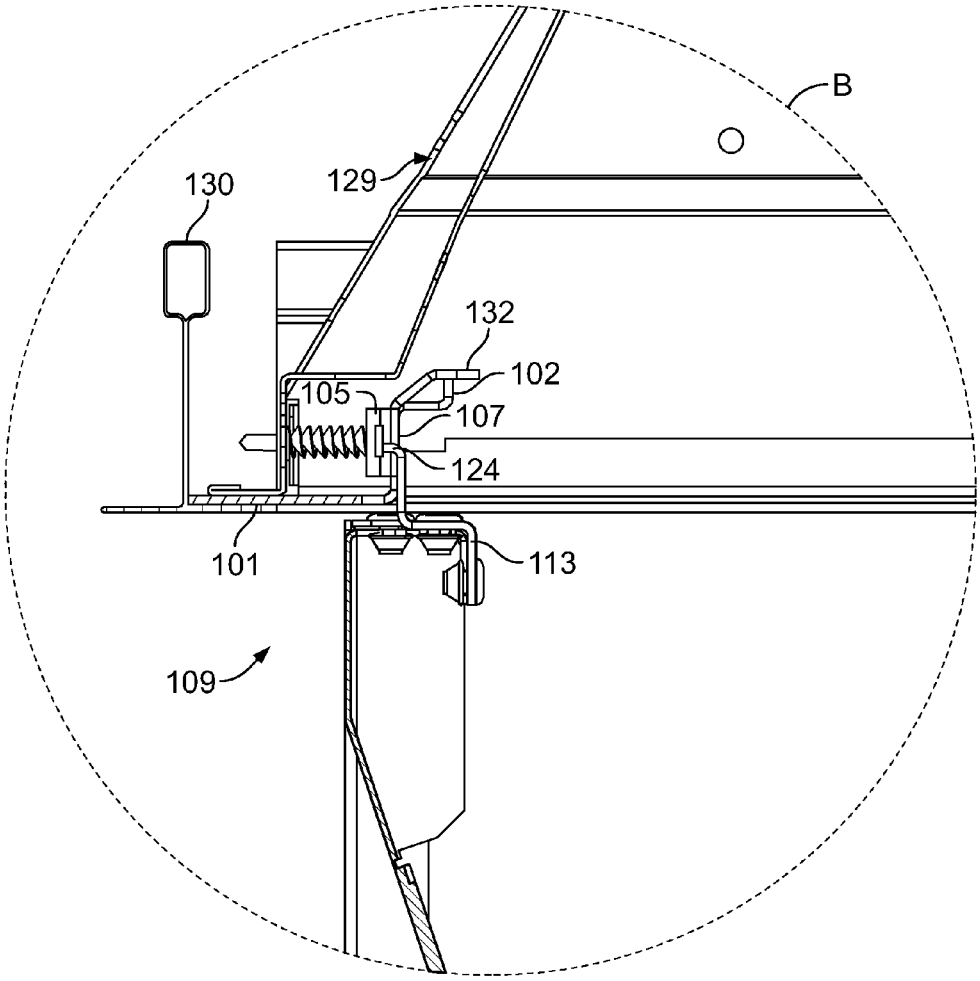
FIG. 27 is a detailed view of section "B" of FIG. 26.

Referring to FIGS. 23-28, another exemplary embodiment of the hinge 113 that can be used to couple the door-light assembly 109 of the present disclosure to a housing of an existing troffer lighting fixture 129, and another exemplary embodiment of a latch that can be used to latch the door-light assembly 109 to the housing of the troffer lighting fixture are provided. In this exemplary embodiment, multiple hinges 113 are used to pivotally mount the door-light assembly 109 to the housing of the troffer lighting fixture 129, and multiple latches 115 are used to latch the door-light assembly 109 to the housing of the troffer lighting fixture. However, a single elongated hinge can be used to couple the door-light assembly 109 of the present disclosure to a housing of an existing troffer lighting fixture 129, and a single latch can be used to latch the door-light assembly 109 to the housing of the troffer lighting fixture. As seen in FIG. 23, this embodiment of the hinge 113 has two plate mounting holes 123 and a mounting flange 124. The hinge 113 of this embodiment is a plate-like structure shaped to wrap around a portion of the flange 112*a* of the reflector assembly 112, as shown. The mounting holes 123 are used to fasten the hinge 113 to the frame of the door-light assembly 109 using fasteners, such as Tek screws, as seen in FIGS. 22 and 27. The mounting flange 124 is used to pivotally couple the door-light assembly 109 to the adapter bracket 100 secured to the housing of the troffer lighting fixture 129.

Figure 24:
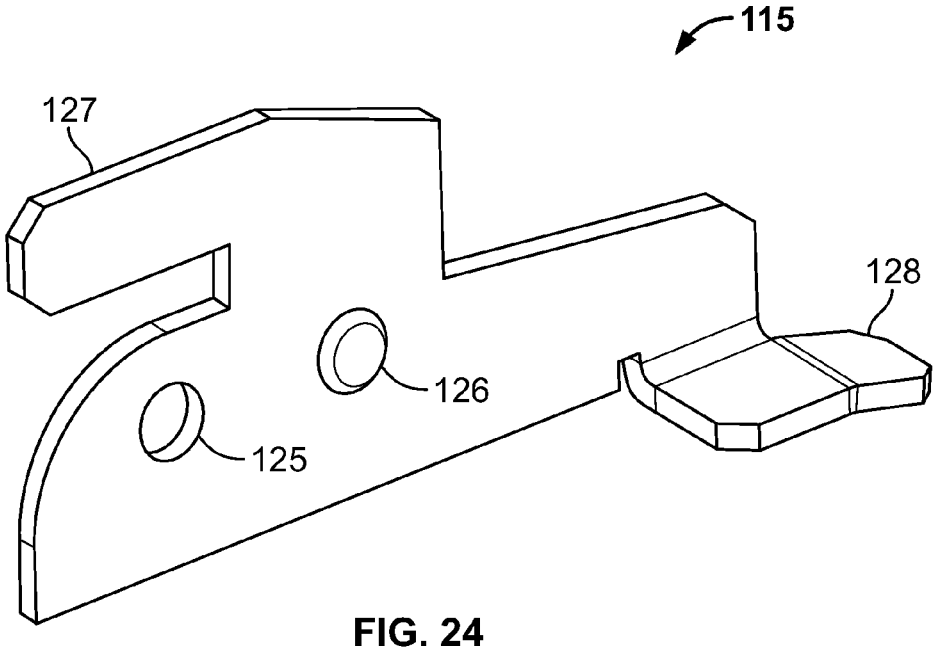
FIG. 24 is a perspective view of another exemplary embodiment of a latch for the door-light assembly of FIG. 18 that can be included as part of a retrofit kit according to the present disclosure.
Figure 28:
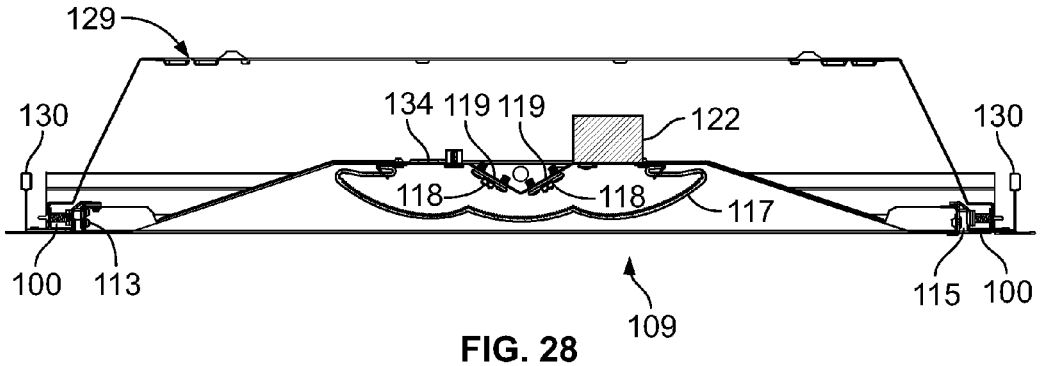
FIG. 28 is a cross-sectional view of the retrofitted troffer lighting fixture of FIG. 25, and illustrating the door light assembly in a latched position.
Figure 29:
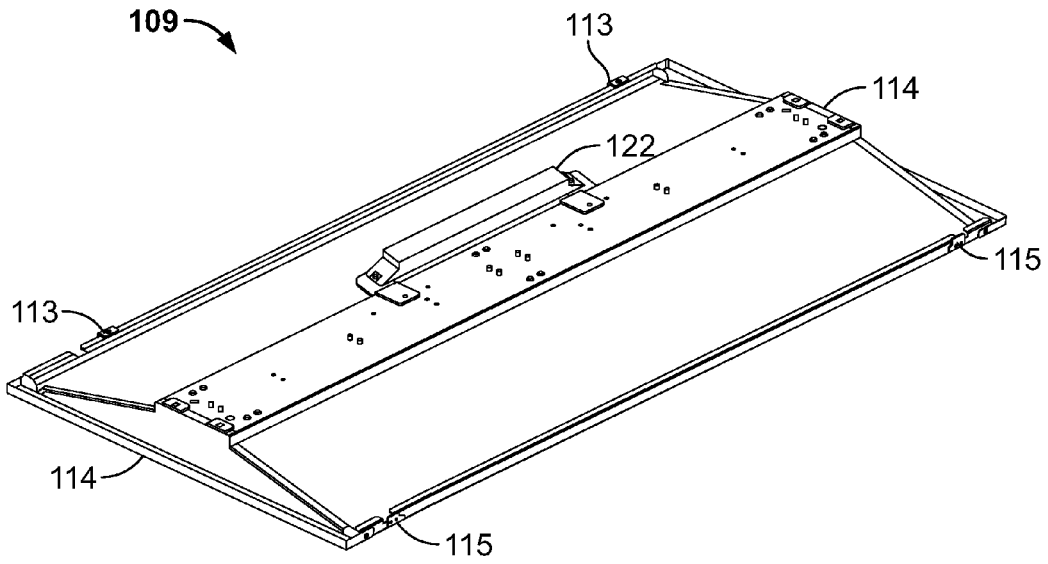
FIG. 29 is a first top perspective view of another exemplary embodiment of a door-light assembly according to the present disclosure that can be included as part of a retrofit kit according to the present disclosure.
Figure 30:
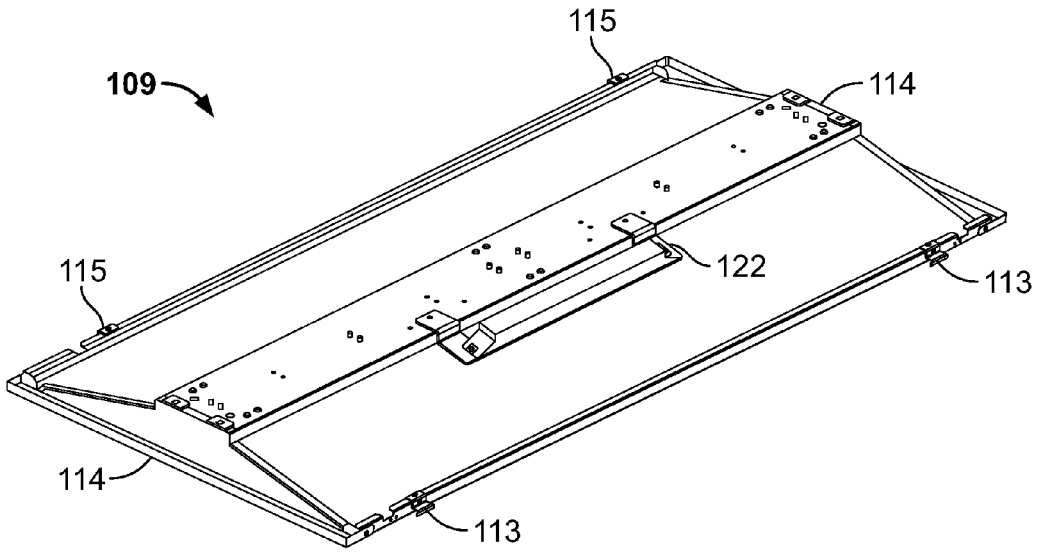
FIG. 30 is a second top perspective view of the door-light assembly of FIG. 29.
Figure 31:
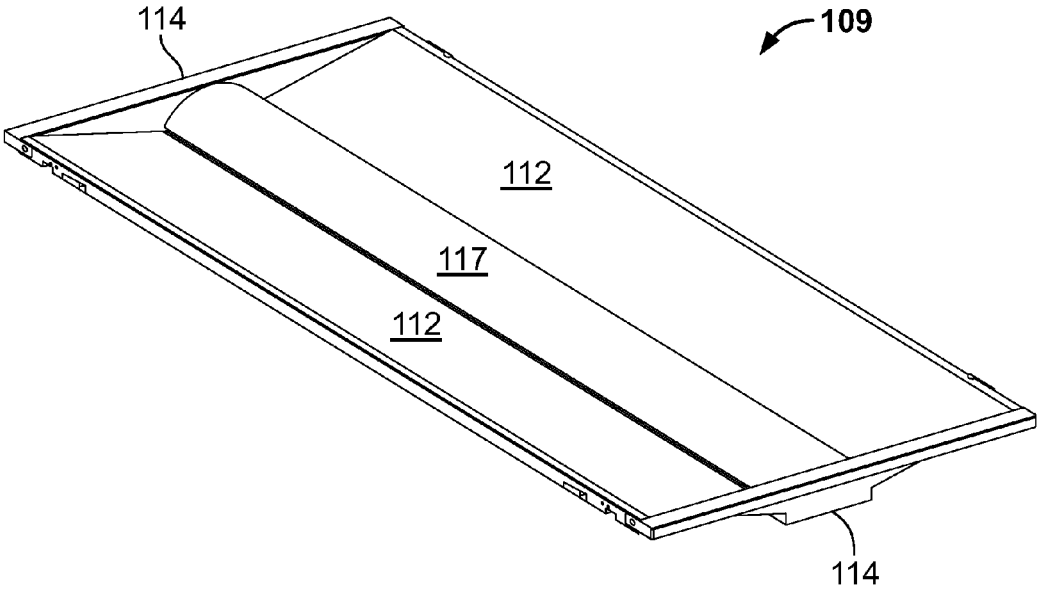
FIG. 31 is a bottom perspective view of the door-light assembly of FIG. 29.
Figure 32:
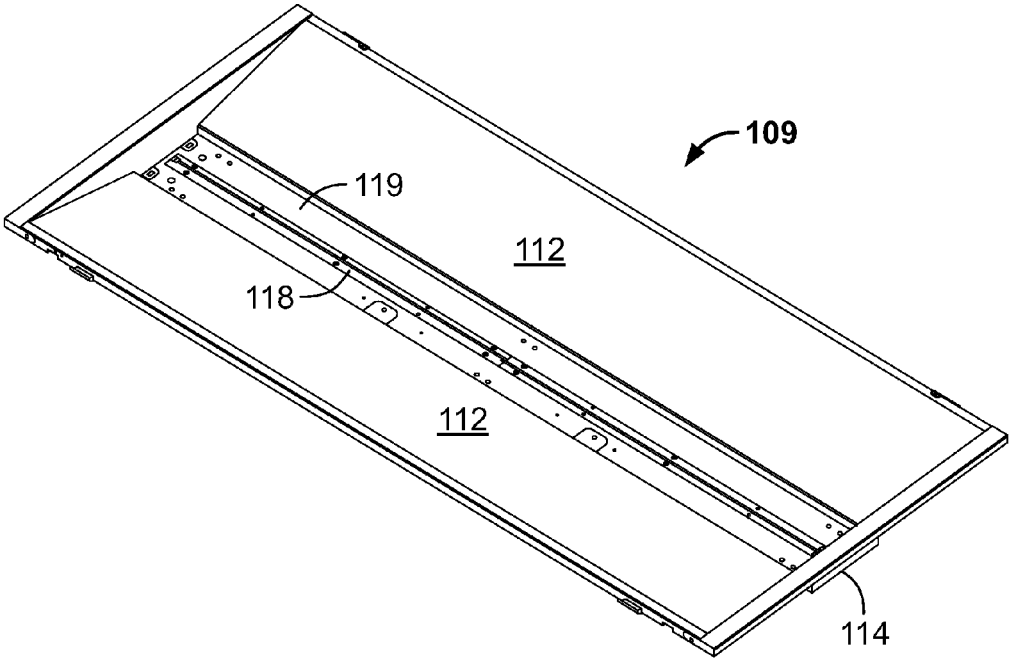
FIG. 32 is a bottom perspective view of the door-light assembly of FIG. 29, illustrating the door-light assembly without an optical lens.
Figure 33:
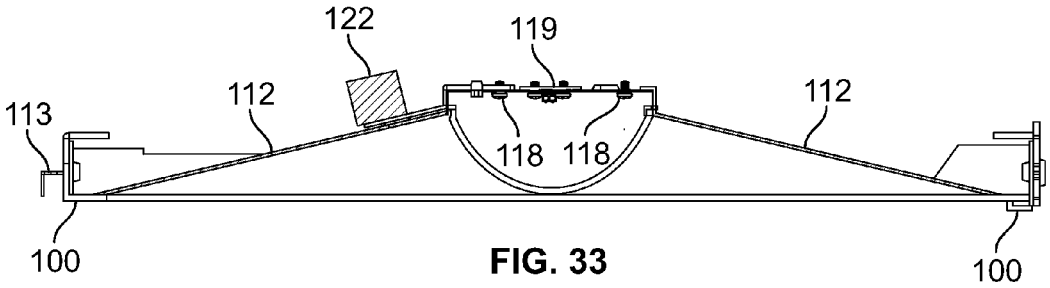
FIG. 33 is a cross-sectional view of the door-light assembly of FIG. 29.
Figure 34:
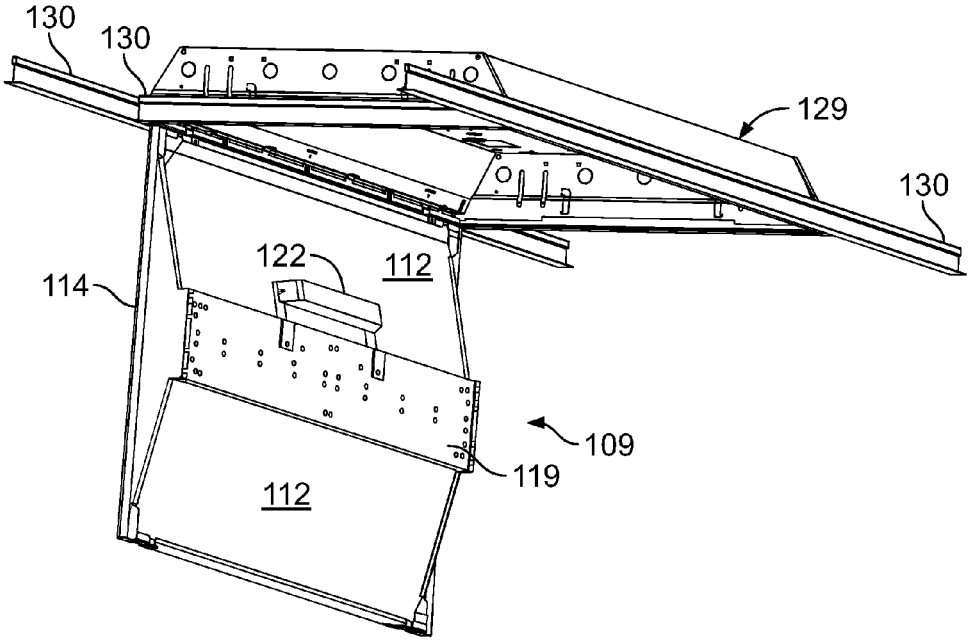
FIG. 34 is a perspective view of a troffer lighting fixture retrofitted with another exemplary embodiment of a retrofit kit according to the present disclosure, and illustrating another exemplary embodiment of a door-light assembly in a suspended position.
Figure 35:
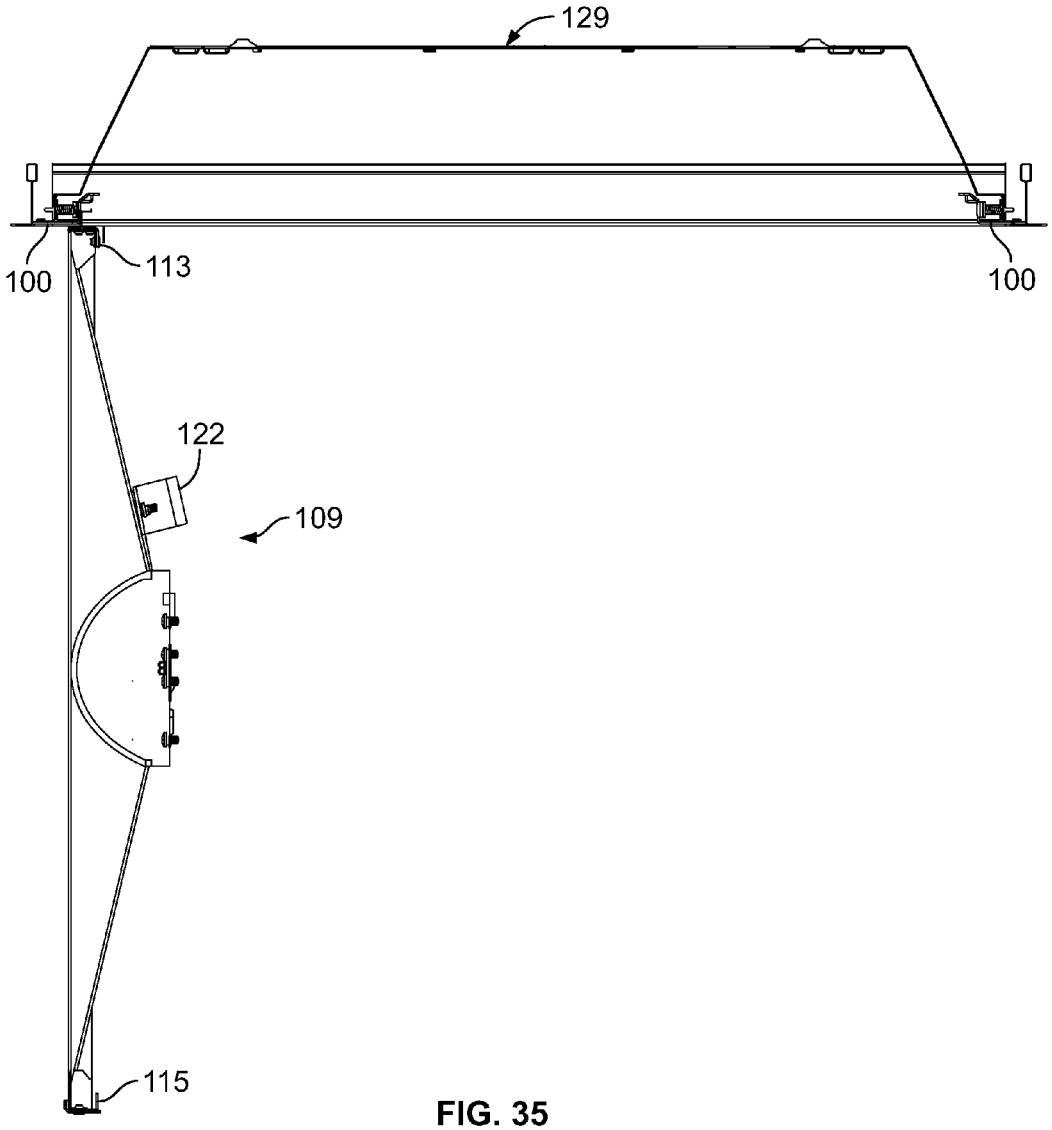
FIG. 35 is a cross-sectional view of the retrofitted troffer lighting fixture of FIG. 34, and illustrating the door-light assembly in a suspended position.
Figure 36:
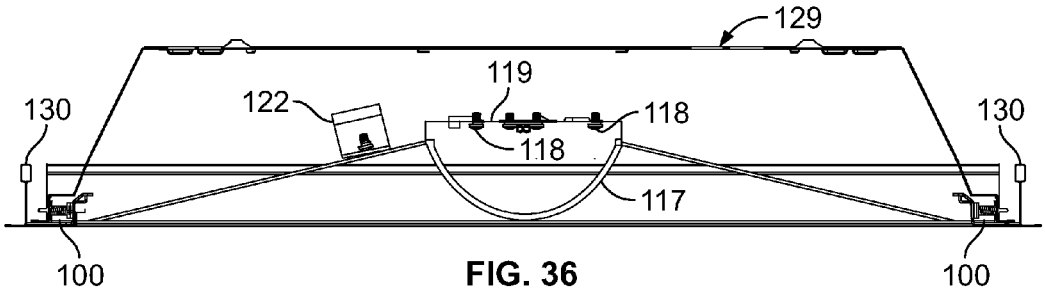
FIG. 36 is a cross-sectional view of the retrofitted troffer lighting fixture of FIG. 34, and illustrating the door-light assembly in a latched position.

As seen in FIG. 24, each latch 115 has a mounting hole 125, a dimple stop 126, a latch lever 127 and a latch tab 128. The mounting hole 125 is used to secure the latch 115 to the frame of the door-light assembly 109 using fasteners, such as Tek screws, so that the cam latch 115 can rotate when force is applied to latch tab 128. Rotating the latch permits engagement or disengagement of the latch lever 127 of the latch 115 with the latch retainer, e.g., the latch tab 102, of adapter bracket 100 attached to the opposite side of the housing of the troffer lighting fixture 129, as seen in FIG. 28. As the latch lever 127 is rotated into engagement with the latch retainer, e.g., the latch tab 102, of the adapter bracket 100, the dimple stop 126 engages a flange 112*a* of the reflector assembly 112 to limit the rotation of the latch 115.

Referring to FIGS. 25-28, the coupling of the retrofit kit, i.e., the door-light assembly 109 to the housing of a troffer lighting fixture 129 using the adapter brackets 100 is shown. In FIGS. 25-27, the door-light assembly 109 is unlatched from the adapter bracket 100 attached to the housing of the troffer lighting fixture 129 such that the door-light assembly is in a suspended position. As noted above, one adapter bracket 100 is used to pivotally couple one side of the door-light assembly 109 to a troffer lighting fixture 129, and another adapter bracket 100 is used to latch the side of the door-light assembly opposite the hinged side to the housing of the troffer lighting fixture. As shown in FIG. 27, the adapter bracket 100 is secured to the housing of the troffer lighting fixture 129 using fasteners so that the adapter bracket 100 is positioned between the troffer lighting fixture and a drop ceiling T-bar 130 when the fixture is installed in a drop ceiling. More specifically, the stop flange 105 of adapter bracket 100 aligns and spaces the mounting flange portion 107 away from the side of the troffer fixture 129, and the base portion 101 of adapter bracket 100 is aligned between the drop ceiling T-bar 130 and the troffer lighting fixture 129. As noted, the mounting flange portion 107 of adapter bracket 100 has two hinge supports, where each hinge support includes a hinge clearance cutout 103 and corresponding hinge retainer tabs 108 on each side of the hinge clearance cutouts 103. The hinge supports are used to couple with hinges 113 secured to the door-light assembly 109. More specifically, the mounting flange 124 of the hinge 113 is positioned within the hinge clearance cutout 103 and the retainer tabs 108 of the hinge support of the adapter bracket 100 to pivotally couple the door-light assembly 109 to the adapter bracket 100. To latch the door-light assembly 109 to the housing of the troffer lighting fixture 129, the door-light assembly 109 is lifted so that it pivots on hinges 113 coupled to adapter bracket 100 until the latches 115 are positioned in close proximity to the latch retainer, e.g., the latch tabs 102, of the other adapter bracket 100. The latch tab 128 is then rotated so that latch lever 127 of latch 115 is rotated into engagement with the latch retainer of adapter bracket 100 until dimple stop 126 of latch 115 engages the flange 112*a* of the reflector assembly 112 such that the door-light assembly 109 is in the latched position, seen in FIG. 28.

Referring to FIGS. 29-36, various views of another exemplary embodiment of a door-light assembly 109 that can be included in the retrofit kit of the present disclosure are provided. In this exemplary embodiment, the door-light assembly 109 has similar features as the door-light assemblies shown in the above described embodiments. In this exemplary embodiment, the control electronics 122 are positioned above an angled portion of the reflector assembly 112, and the flat surface of the reflector assembly 112 acts as the mounting plate 119 capable of supporting one or more rows of solid state lighting sources 118.

Figure 37:
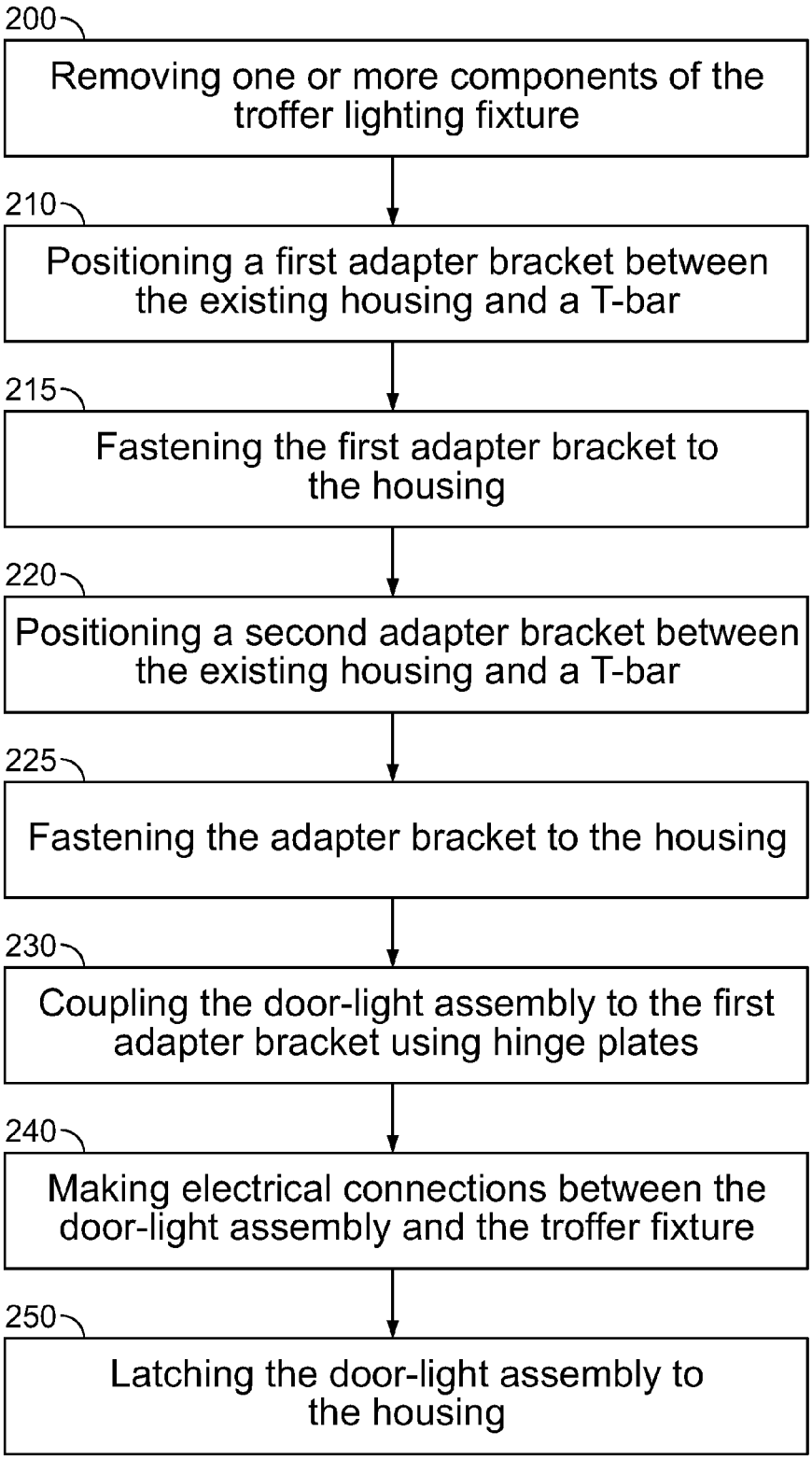
FIG. 37 is a flow diagram of an exemplary embodiment of a method for retrofitting existing troffer light fixtures.

Referring now to FIG. 37, an exemplary embodiment of a flow diagram for a method of retrofitting a troffer lighting fixture is provided. Initially, in step 200, existing components of an existing troffer lighting fixture 129 are removed from the housing of the troffer lighting fixture. As noted above, these components may include reflectors, door frames, lenses, louvers, fluorescent lamps, lamp sockets, socket brackets, ballast units and associated wiring. Once the exiting troffer lighting fixture components are removed, a first adapter bracket 100 is then positioned along a side of the housing of the troffer lighting fixture such that the base portion 101 of the adapter bracket 100 is positioned between the housing of the troffer lighting fixture and a T-bar. The first adapter bracket 100 is then pushed towards the side of the housing of the troffer lighting fixture until the stop flange portion 105 aligns the adapter bracket 100 with the housing of the troffer lighting fixture (at step 210). In step 215, the first adapter bracket 100 is then fastened to the housing of the troffer lighting fixture using fasteners, such as Tek screws, inserted through the cutouts 106 of the adapter bracket 100. In step 220, a second adapter bracket 100 is then positioned along a side of the housing of the troffer lighting fixture that is opposite the side the first adapter bracket 100 is secured, so that the base portion 101 of the adapter bracket 100 is positioned between the housing of the troffer lighting fixture and a T-bar. The second adapter bracket 100 is then pushed towards the side of the housing of the troffer lighting fixture until the stop flange portion 105 aligns the adapter bracket 100 with the housing of the troffer lighting fixture (at step 220). In step 225, the second adapter bracket 100 is then fastened to the housing of the troffer lighting fixture using fasteners, such as Tek screws, inserted through the cutouts 106 of the adapter bracket 100. In step 230, the door-light assembly 109 is pivotally secured to the first adapter bracket 100 using hinge plates 113 as described above. In step 240, the electrical connections for the door-light assembly 109 are made while the door-light assembly 109 is in the suspended position. In step 250, the door-light assembly 109 is then lifted so that it pivots on hinges 113 coupled to adapter bracket 100 until the latches 115 are positioned in close proximity to the latch retainer, e.g., the latch tabs 102, of the other adapter bracket 100. Each latch tab 128 of latch 115 is then rotated so that latch lever 127 of latch 115 is rotated into engagement with the latch retainer of adapter bracket 100 until dimple stop 126 of latch 115 engages the flange 112*a* of the reflector assembly 112 so that the door-light assembly 109 is in the latched position.

The foregoing specification provides a description with reference to specific exemplary embodiments. The specification and drawings are to be regarded in an illustrative sense rather than a restrictive sense. Various modifications may be made thereto without departing from the spirit and scope as set forth in the following claims.

What is claimed is:

1. A retrofit kit for a drop ceiling lighting fixture having a housing, comprising:

a first adapter bracket configured to be secured to the drop ceiling lighting fixture, wherein the first adapter bracket comprises at least one hinge support;

a second adapter bracket configured to be secured to the drop ceiling lighting fixture, wherein the second adapter bracket comprises at least one latch retainer; and a door-light assembly having a first side configured to be pivotally secured to the first adapter bracket and a second side configured to be latched to the second adapter bracket, wherein the second side is opposite the first side, wherein and the door-light assembly comprises at least one hinge configured to be coupled to the at least one hinge support, and the door-light assembly comprises at least one latch configured to latch the door-light assembly to the second adapter bracket, and wherein at least one of the first and second adapter brackets have a stop portion configured to align the door-light assembly with the housing of the drop ceiling lighting fixture.

2. The retrofit kit of claim 1, wherein the latch retainer comprises a tab.

3. The retrofit kit of claim 1, wherein the first and second adapter brackets each have at least one cutout configured to allow a screw to pass through the cutout to permit fastening the adapter brackets to the housing of a drop ceiling lighting fixture.

4. The retrofit kit of claim 1, wherein the door-light assembly comprises:

a reflector assembly having:

a first surface for securing at least one hinge to the reflector assembly;

a second surface for securing at least one latch to the reflector assembly; and at least one light source mounting surface;

at least one solid state lighting source mounted to the at least one light source mounting surface;

control electronics to control power to the at least one solid state lighting source; and a pair of end plates coupled to the reflector assembly.

5. The retrofit kit of claim 4, wherein the at least one optical lens is positioned over the at least one solid state lighting source.

6. The retrofit kit of claim 4, wherein the solid state lighting source comprises an LED module.

7. The retrofit kit of claim 4, wherein the at least one light source mounting surface is flat.

8. The retrofit kit of claim 4, wherein the at least one light source mounting surface is pitched.

9. A door-light assembly for retrofitting drop ceiling light fixtures, the door-light assembly comprising:

a reflector assembly having:

a first surface for securing at least one hinge to the reflector assembly;

a second surface for securing at least one latch to the reflector assembly; and at least one light source mounting surface;

at least one solid state lighting source mounted to the at least one light source mounting surface;

control electronics to control power to the at least one solid state lighting source; and a pair of end plates coupled to the reflector assembly, wherein at least one of the first surface and the second surface has a stop portion configured to align the door-light assembly.

10. The door light assembly of claim 9, wherein at least one optical lens is positioned over the at least one solid state lighting source.

11. The door light assembly of claim 9, wherein the solid state lighting source comprises an LED module.

12. The door light assembly of claim 9, wherein the at least one light source mounting surface is flat.

13. The door light assembly of claim 9, wherein the at least one light source mounting surface is pitched.

14. A method of retrofitting a drop ceiling lighting fixture that can be coupled to an electrical wiring system and positioned within a grid structure, the drop ceiling lighting fixture having a housing for supporting components of the drop ceiling lighting fixture, the method comprising the steps of:

removing at least one of the components within the drop ceiling lighting fixture;

positioning a first adapter bracket along a first side of the housing of the drop ceiling lighting fixture such that a base portion of the first adapter bracket is positioned between the housing of the drop ceiling lighting fixture and the grid structure, wherein the first adapter bracket comprises at least one hinge support;

aligning the first adapter bracket with the housing of the drop ceiling lighting fixture until a stop flange portion of the first adapter bracket is engaged with the housing of the drop ceiling lighting fixture;

fastening the first adapter bracket to the first side of the housing of the drop ceiling lighting fixture;

positioning a second adapter bracket along a second side of the housing of the drop ceiling lighting fixture such that a base portion of the second adapter bracket is positioned between the housing of the drop ceiling lighting fixture and the grid structure wherein the second adapter bracket comprises at least one latch retainer;

aligning the second adapter bracket with the housing of the drop ceiling lighting fixture until a stop flange portion of the second adapter bracket is engaged with the housing of the drop ceiling lighting fixture;

fastening the second adapter bracket to the second side of the housing of the drop ceiling lighting fixture;

coupling a door-light assembly to the first adapter bracket such that the door-light assembly can pivot between a suspended position and a latched position;

connecting the door-light assembly to the electrical wiring system; and latching the door-light assembly to the second adapter bracket such that the door-light assembly is on the latched position.

* * * * *